US010134341B2

(12) United States Patent
Bae

(10) Patent No.: US 10,134,341 B2
(45) Date of Patent: Nov. 20, 2018

(54) DISPLAY DEVICE HAVING A SENSING UNIT FOR COMPENSATING FOR DETERIORATION OF PIXELS

(71) Applicant: Samsung Display Co., Ltd., Yongin-si, Gyeonggi-do (KR)

(72) Inventor: Min Seok Bae, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/344,196

(22) Filed: Nov. 4, 2016

(65) Prior Publication Data

US 2017/0193918 A1 Jul. 6, 2017

(30) Foreign Application Priority Data

Dec. 30, 2015 (KR) ..... 10-2015-0190037

(51) Int. Cl.
*G09G 3/30* (2006.01)
*G09G 3/3283* (2016.01)
*G09G 3/3266* (2016.01)

(52) U.S. Cl.
CPC ..... *G09G 3/3283* (2013.01); *G09G 3/3266* (2013.01); *G09G 2310/027* (2013.01); *G09G 2310/0297* (2013.01); *G09G 2310/08* (2013.01)

(58) Field of Classification Search
CPC ..... G09G 3/3283
USPC ..... 345/77
See application file for complete search history.

(56) References Cited

U.S. PATENT DOCUMENTS

2009/0027423 A1* 1/2009 Kwon ..... G09G 3/3233 345/690
2011/0012819 A1* 1/2011 Ryu ..... G09G 3/3233 345/82
2011/0063283 A1* 3/2011 Ryu ..... G09G 3/3283 345/214
2014/0204071 A1* 7/2014 Kwon ..... G09G 3/3291 345/212
2015/0130866 A1 5/2015 Bae et al.

* cited by examiner

*Primary Examiner* — Long D Pham
(74) *Attorney, Agent, or Firm* — Lewis Roca Rothgerber Christie LLP

(57) ABSTRACT

A display device includes: a pixel unit including pixels, each including an OLED; a scan driver configured to supply scan signals to scan lines connected to the pixels; a data driver configured to supply data signals to data lines connected to the pixels; a control line driver configured to supply control signals to control lines connected to the pixels; a sensing unit configured to receive sensing voltages from the data lines during a sensing period; a switching unit configured to selectively connect the data lines to the data driver and to the sensing unit, and to perform current sensing of the OLEDs of the pixels to which the control signals are supplied from among the plurality of pixels; and a timing controller configured to control the control line driver to supply the control signals to one or more of the control lines according to externally input first data.

36 Claims, 15 Drawing Sheets

DISPLAY DEVICE HAVING A SENSING UNIT FOR COMPENSATING FOR DETERIORATION OF PIXELS

CROSS-REFERENCE TO RELATED APPLICATION

This application claims priority to, and the benefit of, Korean Patent Application No. 10-2015-0190037, filed on Dec. 30, 2015 in the Korean Intellectual Property Office, the entire content of which is incorporated herein by reference in its entirety.

BACKGROUND

1. Field

Aspects of embodiments of the present invention relate to a display device.

2. Description of the Related Art

A variety of display devices have been developed. Examples thereof may include liquid crystal display devices, field emission display devices, plasma display devices, and organic light emitting display devices. These displays are lighter and smaller than conventional cathode ray tube (CRT) displays.

Organic light emitting display devices display images using light emitting diodes that emit light through recombination of electrons and holes. Organic light emitting display devices have a fast response speed and display a clear image.

SUMMARY

Aspects of the present invention provide a display device capable of reducing visibility of an organic light emitting diode during a current sensing operation. An embodiment provides a display device including: a pixel unit including a plurality of pixels, each of the pixels including an organic light emitting diode (OLED); a scan driver configured to supply scan signals to a plurality of scan lines connected to the plurality of pixels; a data driver configured to supply data signals to a plurality of data lines connected to the plurality of pixels; a control line driver configured to supply control signals to a plurality of control lines connected to the plurality of pixels; a sensing unit configured to receive sensing voltages from the plurality of data lines during a sensing period; a switching unit configured to selectively connect the plurality of data lines to the data driver and to the sensing unit, and configured to perform current sensing of the OLEDs of the pixels to which the control signals are supplied from among the plurality of pixels; and a timing controller configured to control operations of the scan driver, the data driver, the control line driver, the sensing unit, and the switching unit, and configured to control the control line driver to supply the control signals to one or more of the control lines according to externally input first data.

The timing controller may include: a frame memory configured to temporarily store the first data; a register configured to store a first reference value, the first reference value configured to determine on which of the pixels the current sensing is to be performed; and a sensing line determination unit configured to calculate a representative value of data corresponding to the pixels in each row according to the first data, and configured to compare the representative value with the first reference value.

When the representative value is greater than the first reference value, the sensing line determination unit may be configured to determine to perform the current sensing of the pixels in a corresponding row.

The control line driver may be configured to supply a control signal to a control line connected to the pixels in the corresponding row in response to the determination to perform the current sensing.

The switching unit may be configured to connect the plurality of data lines to the sensing unit during a single horizontal period corresponding to the corresponding row.

When the representative value is less than or equal to the first reference value, the sensing line determination unit may be configured to determine to omit performing the current sensing of the pixels in a corresponding row.

In response to a determination to omit the performing the current sensing, the control line driver may be configured to omit supplying a control signal to a control line connected to the pixels in the corresponding row.

In response to a determination to omit the performing the current sensing, the scan driver may be configured to supply a scan signal to a scan line connected to the pixels in the corresponding row.

The switching unit may be configured to connect the plurality of data lines to the data driver during a single horizontal period corresponding to the corresponding row.

The pixels in the corresponding row may be configured to receive the data signals from the data driver through the plurality of data lines, and each of the OLEDs may emit light having brightness corresponding to each of the data signals.

The representative value may include a mean value of the data corresponding to the pixels in each row.

The representative value may include a median value of the data corresponding to the pixels in each row.

The representative value may include a mode value of the data corresponding to the pixels in each row.

The sensing unit may be configured to generate deterioration information of the OLEDs of the pixels to which the control signals are supplied according to a result of the current sensing.

The sensing unit may include: a sensing circuit configured to sense voltages generated in the plurality of data lines as the result of the current sensing; and an analog-digital converter configured to convert the voltages sensed by sensing circuit into digital values of the deterioration information of the OLEDs.

The sensing circuit may include: a sensing current source configured to apply a sensing current to the plurality of data lines; and a voltage detector configured to detect the voltages generated in the plurality of data lines when the sensing current source applies the sensing current thereto.

The sensing current source may include a fixed current source.

The sensing current source may include a variable current source.

The display device may further include a control block configured to store the deterioration information generated by the sensing unit.

The timing controller may be configured to receive the deterioration information from the control block, and may be configured to convert the first data into second data according to the deterioration information to compensate for deterioration of the OLEDs of the pixels.

The timing controller may include: a light emitting information storage configured to accumulate and store the input first data; a region detector configured to detect pixels in a first light emitting region from among the plurality of pixels according to the first data; and a sensing line determination unit configured to determine a sensing line on which to perform the current sensing according to the first light emitting region. The first light emitting region may be a region where light is emitted at a certain brightness or greater for a certain amount of time.

The region detector may include: a register configured to store a second reference value and a first critical value; a pixel detector configured to detect pixels sequentially receiving grayscale data greater than the second reference value a certain number of times exceeding the first critical value; and a light emitting region determination unit configured to determine the first light emitting region according to the pixels detected by the pixel detector.

Each of the pixels may further include: a pixel circuit connected to one of the scan lines, to one of the data lines, to one of the control lines, and to an anode electrode of the organic light emitting diode, configured to control current supplied to the organic light emitting diode, and configured to transfer a sensing current to the organic light emitting diode during a current sensing operation period.

The pixel circuit may include a sensing transistor connected between the anode electrode of the organic light emitting diode and the data line, and may include a gate terminal connected to one of the control lines.

According to another embodiment, a display device includes: a pixel unit connected to a plurality of scan lines, to a plurality of data lines, and to a plurality of control lines, the pixel unit including a plurality of pixels; a control line driver configured to supply a control signal to at least one of the control lines according to data input to the plurality of pixels; a sensing unit configured to perform current sensing of the pixels receiving the control signal; and a timing controller configured to control operations of the control line driver and the sensing unit.

The plurality of pixels may be arranged in an n×m matrix format, the plurality of control lines may include n control lines, the timing controller may be configured to determine at least one of the n rows to which the current sensing is to be performed according to the data input to the plurality of pixels, and the control line driver may be configured to supply a control signal to a control line from among the n control lines corresponding to the at least one of the n rows determined by the timing controller.

The timing controller may include: a frame memory configured to store the data input to the plurality of pixels; a register configured to store a first reference value by which the pixels to which the current sensing is to be performed are determined; and a sensing line determination unit configured to calculate a representative value of data corresponding to the pixels in an ith row (where i is a natural number greater than or equal to 1 and less than or equal to n) according to the data stored in the frame memory, and configured to compare the representative value with the first reference value.

When the representative value is greater than the first reference value, the sensing line determination unit may be configured to determine to perform the current sensing of the pixels in the ith row.

The representative value may be a mean value of the data corresponding to the pixels in the ith row.

The timing controller may include: a light emitting information storage configured to accumulate and store the data input to the plurality of pixels; a region detector configured to detect pixels in a first light emitting region from among the plurality of pixels according to the data accumulated and stored in the light emitting information storage; and a sensing line determination unit configured to determine a sensing line to which the current sensing is performed according to the first light emitting region. The first light emitting region may be a region where light is emitted at a certain brightness or greater for a certain amount of time.

The region detector may include: a register configured to store a second reference value and a first critical value; a pixel detector configured to detect pixels sequentially receiving grayscale data greater than the second reference value a certain number of times exceeding the first critical value; and a light emitting region determination unit configured to determine the first light emitting region according to the pixels detected by the pixel detector.

The display device may further include: a data driver configured to supply data signals to the plurality of data lines; a scan driver configured to supply scan signals to the plurality of scan lines; and a switching unit configured to selectively connect the plurality of data lines to one of the data driver and the sensing unit.

The switching unit may include a plurality of demultiplexers configured to demultiplex and supply the data signals output from the data driver to the plurality of data lines.

The sensing unit may include: an initialization voltage source configured to initialize a voltage generation in at least one of the plurality of data lines during a sensing period; and a sensing current source configured to transfer a sensing current to at least one of the plurality of data lines after the initialization voltage source initializes the voltage generated in the at least one of the plurality of data lines.

The sensing unit may include at least one switching element configured to selectively connect one of the initialization voltage source and the sensing current source to at least one of the plurality of data lines.

The plurality of pixels may be arranged in an n×m matrix format, and the sensing unit may include: a sensing current source configured to supply a sensing current to a jth data line (where j is a natural number greater than or equal to 1 and is less than or equal to m) from among the plurality of data lines; and a difference circuit configured to output a voltage difference between a voltage in the jth data line and a voltage in a data line adjacent to the jth data line when the sensing current source supplies the sensing current to the jth data line.

The sensing unit may further include a switching element configured to selectively connect the sensing current source to the jth data line.

BRIEF DESCRIPTION OF THE DRAWINGS

Example embodiments are described hereinafter with reference to the accompanying drawings. The present invention, including exemplary systems and methods thereof, however, should not be construed as being limited to these embodiments. Rather, these embodiments are provided to facilitate the understanding by those of ordinary skill in the art.

In the drawings, dimensions may be exaggerated for clarity. It is understood that when an element is illustrated as being between two elements, it may be the only element between the two elements, or one or more intervening elements may also be present. Like reference numerals refer to like elements throughout.

DETAILED DESCRIPTION

Figure 1:
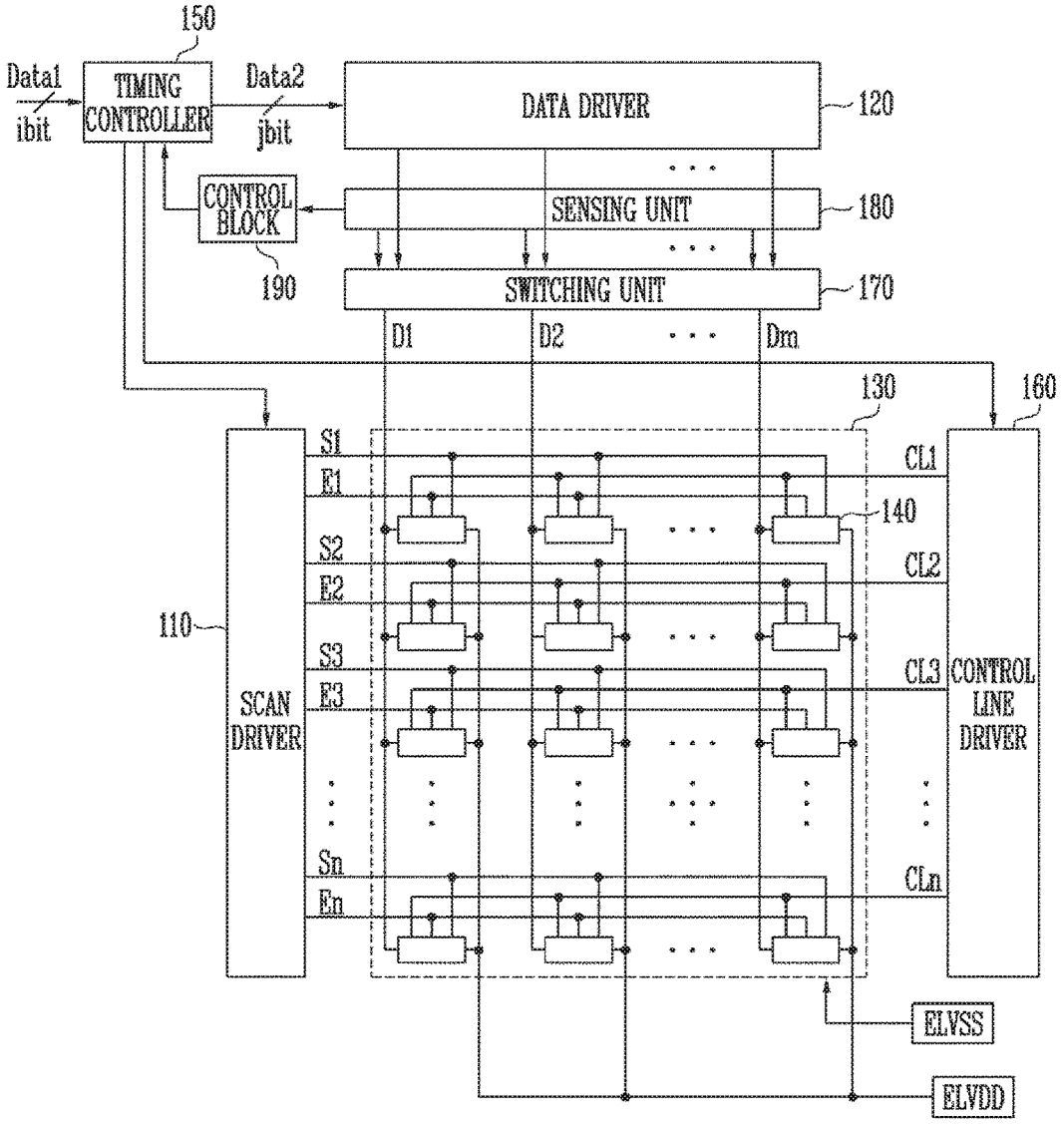
FIG. 1 is a block diagram illustrating a display device according to an embodiment.

Hereinafter, example embodiments will now be described more fully herein with reference to the accompanying drawings; however, the inventive concept may be embodied in different forms and is not limited to the embodiments set forth herein. Rather, these embodiments are provided so that this disclosure is thorough and complete, and fully convey the scope of the inventive concept to those skilled in the art.

It will be understood that when an element or layer is referred to as being "on," "connected to," or "coupled to" another element or layer, it may be directly on, connected, or coupled to the other element or layer or one or more intervening elements or layers may also be present. When an element is referred to as being "directly on," "directly connected to," or "directly coupled to" another element or layer, there are no intervening elements or layers present. For example, when a first element is described as being "coupled" or "connected" to a second element, the first element may be directly coupled or connected to the second element or the first element may be indirectly coupled or connected to the second element via one or more intervening elements. The same reference numerals designate the same elements. As used herein, the term "and/or" includes any and all combinations of one or more of the associated listed items. Further, the use of "may" when describing embodiments of the present invention relates to "one or more embodiments of the present invention." Expressions, such as "at least one of," when preceding a list of elements, modify the entire list of elements and do not modify the individual elements of the list. Also, the term "exemplary" is intended to refer to an example or illustration. As used herein, the terms "use," "using," and "used" may be considered synonymous with the terms "utilize," "utilizing," and "utilized," respectively.

It will be understood that, although the terms first, second, third, etc. may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section without departing from the teachings of example embodiments. In the figures, dimensions of the various elements, layers, etc. may be exaggerated for clarity of illustration.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" or "over" the other elements or features. Thus, the term "below" may encompass both an orientation of above and below. The device may be otherwise oriented (rotated 90 degrees or at other orientations), and the spatially relative descriptors used herein should be interpreted accordingly.

The terminology used herein is for the purpose of describing particular example embodiments of the present invention and is not intended to be limiting of the described example embodiments of the present invention. As used herein, the singular forms "a" and "an" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components but do not preclude the presence or addition of one or more other features, integers, steps, operations, elements, components, and/or groups thereof.

The scan driver, the data driver, the control line driver, the sensing unit, the switching unit, the timing controller, and/or any other relevant devices or components according to embodiments of the present invention described herein may be implemented utilizing any suitable hardware, firmware (e.g., an application-specific integrated circuit), software, and/or a suitable combination of software, firmware, and hardware. For example, the various components of the scan driver, the data driver, the control line driver, the sensing unit, the switching unit, and/or the timing controller may be formed on one integrated circuit (IC) chip or on separate IC chips. Further, the various components of the scan driver, the data driver, the control line driver, the sensing unit, the switching unit, and/or the timing controller may be implemented on a flexible printed circuit film, a tape carrier package (TCP), a printed circuit board (PCB), or formed on a same substrate as the scan driver, the data driver, the control line driver, the sensing unit, the switching unit, and/or the timing controller. Further, the various components of the scan driver, the data driver, the control line driver, the sensing unit, the switching unit, and/or the timing controller may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device or the functionality of a particular computing device may be distributed across one or more other computing devices without departing from the scope of the exemplary embodiments of the present invention.

FIG. 1 is a block diagram illustrating a display device according to an embodiment.

Referring to FIG. 1, the display device may include a pixel unit 130 (e.g., a pixel array), a scan driver 110, a control line driver 160, a data driver 120, and a timing controller 150. The pixel unit 130 may include a plurality of pixels 140 connected to scan lines S1 to Sn, light emission control lines E1 to En, and data lines D1 to Dm. The scan driver 110 may drive the scan lines S1 to Sn and the light emission control lines E1 to En. The control line driver 160 may drive control lines CL1 to CLn. The data driver 120 may drive the data lines D1 to Dm. The timing controller 150 may control the scan driver 110, the data driver 120, and the control line driver 160.

The display device may further include a sensing unit 180 (e.g., a sensor), a switching unit 170 (e.g., a switch), and a control block 190 (e.g., a control circuit). The sensing unit 180 may include one or more sensing circuits, and may extract (determine) deterioration information of an organic light emitting diode (OLED) included in a respective one of the pixels 140. The switching unit 170 may include one or more switches, and may selectively connect the sensing unit 180 and the data driver 120 to the data lines D1 to Dm. The control block 190 may store the information sensed by (determined by) the sensing unit 180.

The pixels 140 may be respectively arranged or located at intersections of the scan lines S1 to Sn, the light emission control lines E1 to En, and the data lines D1 to Dm. For example, the pixels 140 may be arranged in an n×m matrix. The pixels 140 may receive a first power supply ELVDD (e.g., a first power voltage) and a second power supply ELVSS (e.g., a second power voltage) from an external device. Each of the pixels 140 may control the amount of current supplied to the second power supply ELVSS from the first power supply ELVDD via a corresponding OLED in response to a data signal, such that the corresponding OLED generates light having a certain brightness (e.g., a predetermined brightness).

The scan driver 110 may sequentially supply scan signals to the scan lines S1 to Sn under the control of the timing controller 150. In addition, the scan driver 110 may supply light emission control signals to the light emission control lines E1 to En under the control of the timing controller 150.

The control line driver 160 may sequentially supply control signals to the control lines CL1 to CLn under the control of the timing controller 150. The control signal transmitted to each of the pixels 140 may be a signal supplied to sense (to determine) a degree of deterioration (e.g., a deterioration degree) of the OLEDs in the pixels 140. The processes by which the deterioration degree of each OLED of the pixels 140 is sensed upon receiving the control signal will be further described below with reference to FIG. 2.

The data driver 120 may generate data signals, and may supply the generated data signals to the data lines D1 to Dm under the control of the timing controller 150. For example, the data driver 120 may generate data signals corresponding to second data Data2 supplied from the timing controller 150, and may respectively supply the generated data signals to the pixels 140 through the data lines D1 to Dm. Therefore, each of the pixels 140 may emit light having brightness corresponding to the second data Data2.

The switching unit 170 may selectively connect the sensing unit 180 and the data driver 120 to the data lines D1 to Dm. The switching unit 170 may include one or more switching elements (e.g., switches) which are respectively connected to the data lines D1 to Dm (e.g., are respectively connected to each channel).

The sensing unit 180 may extract (determine) the deterioration information of the OLED included in each of the pixels 140 and may provide the extracted deterioration information to the control block 190. The sensing unit 180 may include sensing circuits respectively connected to the data lines D1 to Dm (e.g., respectively connected to channels).

The control block 190 may store the deterioration information supplied from the sensing unit 180. The control block 190 may store (e.g., may substantially store) deterioration information of the OLEDs included in the pixels. The control block 190 may include a memory, and a control unit that is configured to transmit information stored in the memory to the timing controller 150.

The timing controller 150 may control the data driver 120, the scan driver 110, and the control line driver 160. In addition, the timing controller 150 may convert a bit value of first data Data1, which may be externally supplied in response to information provided from the control block 190, to generate the second data Data2. The first data Data1 may have i bits (i is a natural number), and the second data Data2 may have j bits (j is a natural number greater than i). The information provided from the control block 190 may reflect the deterioration degree of the OLED of each of the pixels 140 in the pixel unit 130. Therefore, the second data Data2 may be obtained by compensating for the deterioration of each of the OLEDs.

The second data Data2 generated by the timing controller 150 may be provided to the data driver 120. The data driver 120 may generate data signals by using the received second data Data2, and may provide the generated data signals to the pixels 140.

The sensing unit 180 of the display device according to an embodiment may perform current sensing of (e.g., may sense a current of) OLEDs of some of (e.g., a portion or group of) the plurality of pixels 140 on the basis of (according to) pixel data corresponding to the plurality of the pixels 140. As illustrated in FIG. 1, the scan lines S1, S2, . . . , and Sn and the control lines CL1, CL2, . . . , and CLn may be connected to the plurality of pixels 140 in a row direction. In addition, the data lines D1, D2, . . . , and Dm may be connected to the plurality of pixels 140 in a column direction. The sensing unit 180 may perform current sensing of OLEDs of some of the pixels 140 corresponding to one or more rows from among all of the pixels 140 in the pixel unit 130 in response to a signal from (e.g., in response to control of) the timing controller 150. For example, the timing controller 150 may receive the first data Data1, and may analyze the first data Data1 in terms of how the first data Data1 corresponds to units of rows. For example, the timing controller 150 may calculate a mean value of grayscale values of the pixels 140 included in the first data Data1 with respect to each row of pixels 140. In other words, the timing controller 150 may calculate a mean value of grayscale data input to m pixels corresponding to a first row of the pixel unit 130. When the calculated mean value of the grayscale data is greater than a reference value, the timing controller 150 may determine to operate (e.g., may operate or perform) current sensing of the OLEDs of the pixels 140 located in the first row. The timing controller 150 may control the switching unit 170 and the control line driver 160 to perform the current sensing of the OLEDs of the pixels 140 in the first row. When the calculated mean value of the grayscale data is less than or equal to the reference value, the timing controller 150 may determine to not perform (e.g., may not perform) the current sensing of the OLEDs of the pixels 140 in the first row.

The above-described operations may be repeated with respect to the second to nth rows of the pixels 140. As a result, the display device according to an embodiment may perform current sensing on OLEDs of the pixels in (corresponding to) one or more rows from among all of the pixels 140 (e.g., the pixels 140 in all n rows).

The timing controller 150 of the display device may perform the current sensing of one or more of the plurality of pixels 140 based on input data. According to an embodiment, the timing controller 150 may operate such that the current sensing may be selectively performed on OLEDs of the pixels 140 located in rows where high (relatively high) grayscale values are displayed or measured. Therefore, while the display device is being driven, and even when an OLED of a corresponding pixel emits light due to the current sensing operation, visibility of the pixels 140 undergoing the current sensing operation, as perceived by a user, may be reduced due to the relatively high mean value of grayscale values of the pixels of the row selected to undergo the current sensing operation. Therefore, image quality of the display device may be improved.

Figure 2:
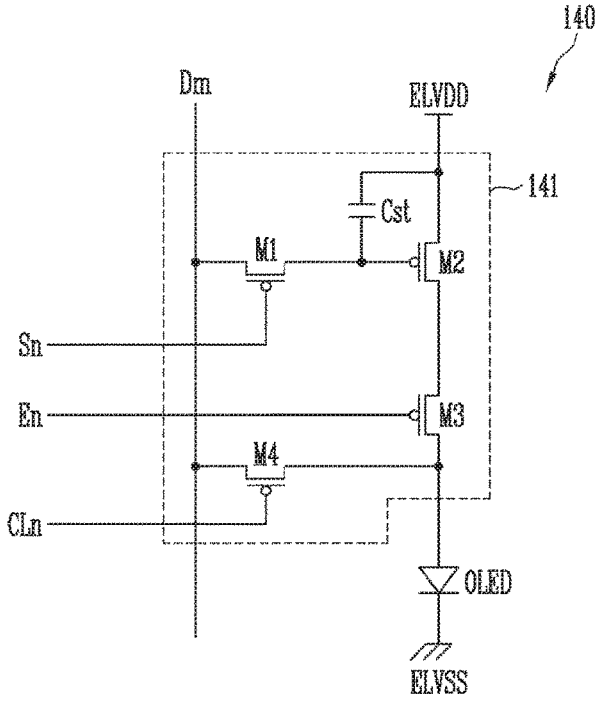
FIG. 2 is a circuit diagram of an embodiment of a pixel included in a pixel unit shown in FIG. 1.

FIG. 2 is a circuit diagram of an embodiment of one of the pixels 140 included in the pixel unit 130 shown in FIG. 1. For convenience of explanation, a pixel that is connected to an mth data line Dm and to an nth scan line Sn is illustrated in FIG. 2.

Referring to FIG. 2, each of the pixels 140 according to a first embodiment may include an organic light emitting diode (OLED) and a pixel circuit 141 for supplying current to the OLED.

An anode electrode of the OLED may be connected to the pixel circuit 141, and a cathode electrode of the OLED may be connected to the second power supply ELVSS. The OLED may generate light having a certain brightness (e.g., a predetermined brightness) in response to the current provided from the pixel circuit 141.

The pixel circuit 141 may receive a data signal supplied to (or by) the data line Dm when a scan signal is supplied to (or by) the scan line Sn. In addition, the pixel circuit 141 may provide the deterioration information of the OLED to the sensing unit 180 when a control signal is supplied to (or by) the control line CLn. The pixel circuit 141 may include four transistors (first to fourth transistors M1-M4) and a storage capacitor Cst.

A gate electrode of the first transistor M1 may be connected to the scan line Sn, a first electrode of the first transistor M1 may be coupled to the data line Dm, and a second electrode of the first transistor M1 may be connected to a first terminal of the storage capacitor Cst. The first transistor M1 may be turned on when the scan signal is supplied to the scan line Sn (e.g., the first transistor M1 may be turned on in response to the scan signal).

A gate electrode of the second transistor M2 may be coupled to the first terminal of the storage capacitor Cst, and a first electrode of the second transistor M2 may be connected to a second terminal of the storage capacitor Cst and to the first power supply ELVDD. The second transistor M2 may control the amount of current flowing from the first power supply ELVDD to the second power supply ELVSS via the OLED in response to a voltage value stored in the storage capacitor Cst. The OLED may generate light corresponding the amount of current provided from the second transistor M2.

A gate electrode of the third transistor M3 may be connected to the light emission control line En, a first electrode of the third transistor M3 may be connected to a second electrode of the second transistor M2, and a second electrode of the third transistor M3 may be connected to the OLED. The third transistor M3 may be turned off when a light emission control signal is supplied to the light emission control line En, and may be turned on when the light emission control signal is not supplied. When the scan signal is supplied, the storage capacitor Cst may be charged with a voltage corresponding to the data signal.

The fourth transistor M4 may be a sensing transistor, and may be turned on during a current sensing operation period of the OLED. For example, a gate electrode of the fourth transistor M4 may be connected to the control line CLn, a first electrode of the fourth transistor M4 may be connected to the second electrode of the third transistor M3, and a second electrode of the fourth transistor M4 may be connected to the data line Dm. The fourth transistor M4 may be turned on when the control signal is supplied to the control line CLn, and may be turned off for (during) the remaining period (e.g., the other period(s)). When the control signal is supplied, the deterioration information of the OLED is sensed.

Referring to FIGS. 1 and 2, the timing controller 150 of the display device according to an embodiment may determine some pixels on which current sensing is to be performed on the basis of the data Data1 corresponding to each of the pixels 140 in the pixel unit 130. For example, the timing controller 150 may determine a row of pixels on which the current sensing is to be performed on the basis of the data Data1 being input. A result of the determination may be transmitted to the control line driver 160, and the control line driver 160 may selectively supply the control signal to at least one control line corresponding to the row on which the current sensing is performed from among the first to nth control lines CL1 to CLn.

For example, when it is determined that the current sensing is to be performed on the pixels 140 included in an nth row, the control line driver 160 may supply the control signal to the nth control line CLn in response to a signal from the timing controller 150, such that the fourth transistor(s) M4 may be turned on, and such that current flowing in (through) the corresponding OLED(s) may also flow in (though) the corresponding data line(s) (e.g., Dm) (e.g., the OLED and the data line may be electrically connected to each other).

While the current sensing is performed on the pixels 140 included in the nth row by the control line driver 160, the switching unit 170 may connect the first to mth data lines D1 to Dm to the sensing unit 180. Therefore, current flowing through the data lines D1 to Dm may also flow through the sensing unit 180, and the deterioration information of the OLEDs in the pixels 140 may be obtained by voltages measured from the data lines D1 to Dm.

Figure 15:
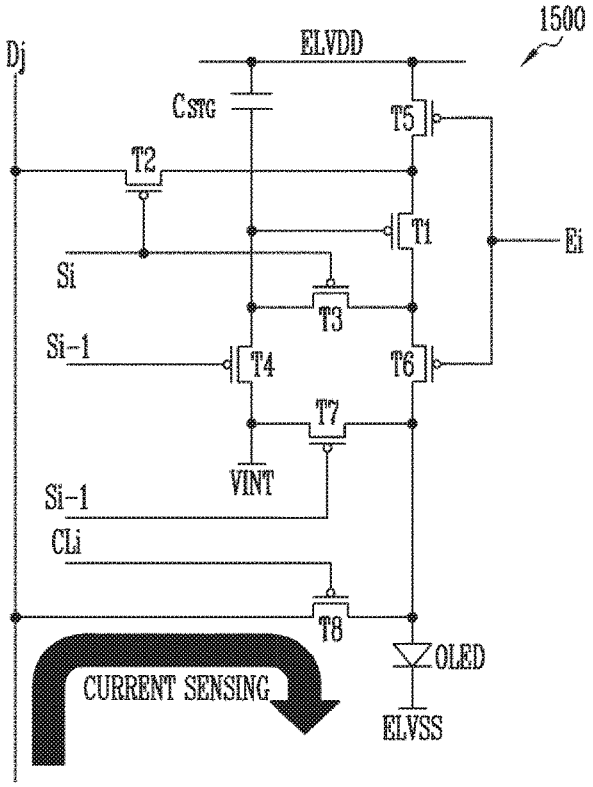
FIG. 15 is a circuit diagram illustrating an embodiment of a pixel shown in FIG. 14.

FIG. 2 illustrates that the pixel circuit 141 includes the four transistors (M1 to M4) and one storage capacitor (Cst). However, the pixels 140 of display device according to another embodiment are not limited thereto. For example, as illustrated in FIG. 15, a pixel including eight transistors (T1 to T8) and one storage capacitor ($C_{STG}$) may also be used.

Figure 3:
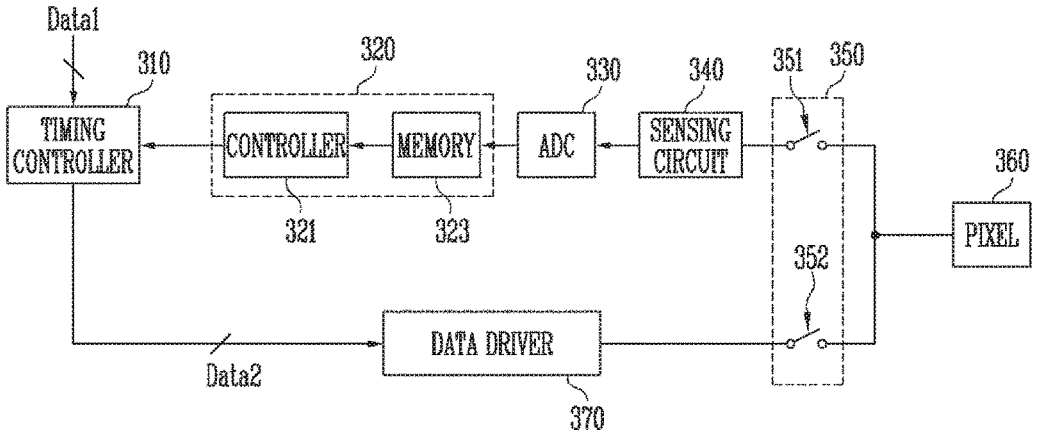
FIG. 3 is a schematic diagram of a switching unit, a sensing unit, and a control block illustrated in FIG. 1.

FIG. 3 is a schematic diagram of a switching unit, a sensing unit, and a control block. For convenience of explanation, FIG. 3 illustrates that a switching unit 350, a sensing unit, and a control block 320 are connected to the mth data line Dm.

Referring to FIG. 3, each channel of the switching unit 350 may include two (e.g., first and second) switching elements 351 and 352. In addition, each channel of the sensing unit may include a sensing circuit 340 and an analog-digital converter (hereinafter, "ADC") 330. In one embodiment, one ADC may be employed per a plurality of channels. In another embodiment, all of the channels may share a single ADC. In addition, the control block 320 may include a memory 323 and a controller 321.

The second switching element 352 may be located between a data driver 370 and the data line Dm, which is in turn connected to a pixel 360. The second switching element 352 may be turned on when a data signal is supplied from the data driver 370. For example, the second switching element 352 may be maintained in a turn-on state (e.g., an on state) while the display device displays a certain image (e.g., a predetermined image). The first switching element 351 may remain turned off (e.g., in an off state) while the second switching element 352 is turned on.

Figure 8A:
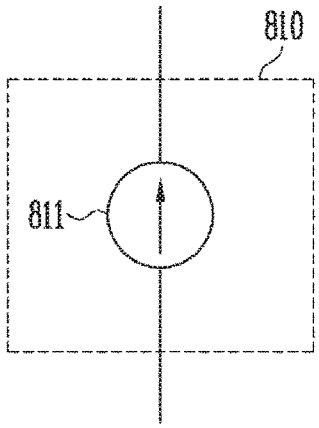
FIG. 8A is a view of an embodiment of a sensing current source included in a sensing circuit shown in FIG. 3.
Figure 8B:
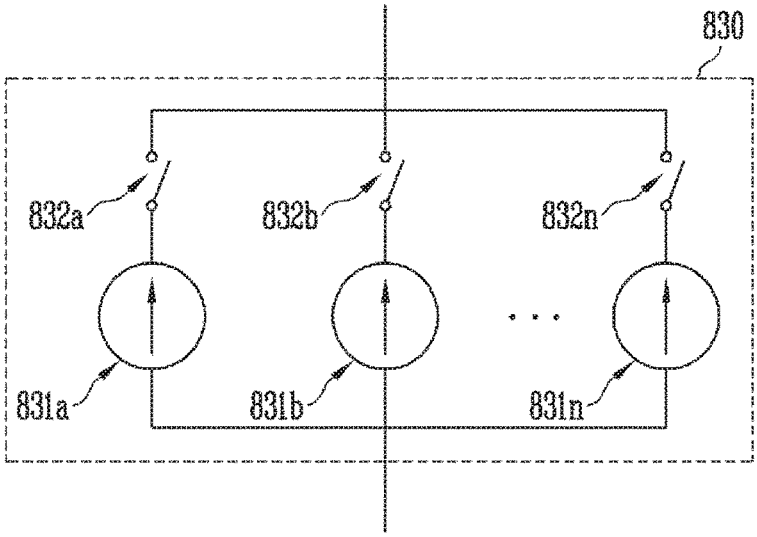
FIG. 8B is a view of another embodiment of a sensing current source included in a sensing circuit shown in FIG. 3.

The sensing circuit 340 may include at least one current source as illustrated in FIGS. 8A and 8B. The current source (e.g., current source 811 of FIG. 8A) included in the sensing circuit 340 may supply a current (e.g., a predetermined current) to the pixel 360 when the first switching element 351 is turned on, and may transmit a voltage generated in the data line Dm (e.g., a voltage provided to the data line Dm) to the ADC 330 when the current is supplied, the voltage corresponding resistance of the pixel 360. The current may be supplied via an organic light emitting diode (OLED) included in the pixel 360. Therefore, the voltage in the data line Dm from the current source in the sensing circuit 340 may have deterioration information of the OLED in the pixel 360. For example, when the deterioration information of the OLED of the pixel 360 is sensed (determined), the first switching element 351 may be turned on and the second switching element 352 may remain turned off.

The sensing circuit 340 may further include a voltage detector configured to sense a voltage generated in each of the data lines D1 to Dm when the sensing current is applied thereto. The voltage detector may sense the voltage generated in (e.g., applied to) each of the data lines D1 to Dm when the sensing current flows via (through) each of the OLEDs. The sensed voltage may be a value reflecting (indicating) a deterioration degree of each of the OLEDs.

For example, as the OLED deteriorates, a resistance (e.g., a resistance value) of the OLED may change. Therefore, a voltage (e.g., a voltage value) of the data line may change when the sensing current flows due to the deterioration of the OLED, and deterioration information of the OLED may be extracted (determined). The current (e.g., the current value or the predetermined current value) provided from the current source in the sensing circuit 340 may be experimentally determined.

The ADC 330 may convert the voltage provided from the sensing circuit 340 into a digital value.

The control block 320 may include the memory 323 and the controller 321.

The memory 323 may store the digital value provided from the ADC 330. The memory 323 may store (e.g., may substantially store) the deterioration information of the OLED included in each of the pixels 140 included in the pixel unit 130 shown in FIG. 1.

The controller 321 may transmit the digital value(s) stored in the memory 323 to the timing controller 310. That is, the controller 321 may transmit the digital value extracted from the pixel 360, to which the first data Data1 input to the timing controller 310 has been provided, to the timing controller 310.

The timing controller 310 may receive the first data Data1 from an external device, and may receive the digital value from the controller 321. The timing controller 310 receiving the digital value may generate the second data Data2 by changing the bit value of the first data Data1 so that an image having uniform, or consistent, brightness may be displayed.

For example, the timing controller 310 may generate the second data Data2 by increasing the bit value of the first data Data1 on the basis of (according to) the digital value as the deterioration of the OLED increases. As a result, the second data Data2, which reflects the deterioration information of the OLED, may be generated such that the OLED does not emit light having lower or reduced brightness as the deterioration increases.

The data driver 370 may generate a data signal by using the second data Data2, and may provide the generated data signal to the pixel 360. The data signal generated by the data driver 370 may be transferred to the pixel 360 through the second switching element 352. For example, the second switching element 352 may be turned on, and the first switching element 351 may remain turned off when the data signal is transmitted from the data driver 370 to the pixel 360.

Figure 4:
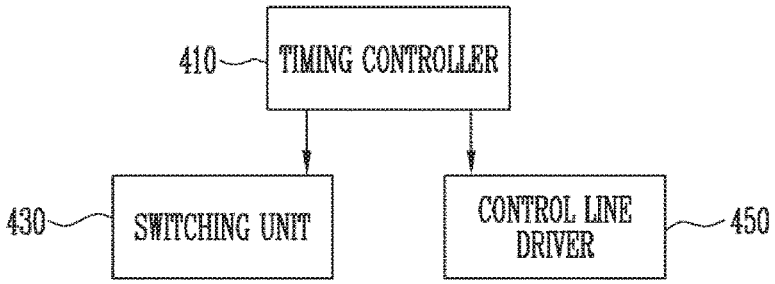
FIG. 4 is a block diagram illustrating a portion of a display device according to an embodiment.

FIG. 4 is a block diagram illustrating a portion of a display device according to an embodiment of the present disclosure.

Referring to FIG. 4, a display device according to an embodiment may include a timing controller 410, a switching unit 430, and a control line driver 450. The timing controller 410, the switching unit 430, and the control line driver 450 shown in FIG. 4 may be respectively the same as, or substantially the same as, the timing controller 150, the switching unit 170, and the control line driver 160 shown in FIG. 1. For convenience of description, and to describe a sensing operation of the display device, FIG. 4 only illustrates some of the components of the display device.

The timing controller 410 may control the switching unit 430 and the control line driver 450 on the basis of (according to) data input thereto. As described above, a display device according to an embodiment may selectively perform the current sensing operation of pixels located in a certain row (e.g., a predetermined row) from among all of the pixels in the pixel unit on the basis of (according to) the input data. For example, the timing controller 410 may select a row to which the current sensing of the OLED will be performed.

The timing controller 410 may transfer information about the selected row of pixels to the switching unit 430 and to the control line driver 450. The switching unit 430 and the control line driver 450 may operate on the basis of (according to) the provided information. The switching unit 430 may selectively connect the sensing unit and the data driver to the data lines on the basis of the provided information. The control line driver 450 may activate a control signal for the selected row on the basis of the provided information.

For example, when the timing controller 410 determines to perform current sensing of OLEDs of the pixels located in an ith row (i being a natural number), the timing controller 410 may transfer the information about the selected row of pixels to the switching unit 430 and to the control line driver 450. The control line driver 450 may activate a control signal applied to an ith control line CLi. The switching unit 430 may connect first to mth data lines Di to Dm to the sensing unit 180 when the control signal applied to the ith control line CLi is activated. Therefore, the pixels located in the ith row may not be connected to the data driver 120, but may instead be connected to the sensing unit 180 during the above period. The sensing unit 180 may apply a sensing current to the first to mth data lines Di to Dm, and may sense (determine) deterioration information of the OLEDs included in m pixels located in the ith row.

The timing controller 410 may control operations of a scan driver as well as the switching unit 430 and the control line driver 450. For example, while current sensing is performed on the OLEDs of the pixels located in the ith row, the timing controller 410 may control the scan driver so as not to activate an ith scan signal Si. Referring to FIGS. 2 and 4, while the current sensing is performed on the OLEDs of the pixels located in ith rows in the pixel unit, the fourth transistor M4 may maintain a turn-on state (e.g., may be turned on) and the first transistor M1 may maintain a turn-off state (e.g., may be turned off). Therefore, while the current sensing is performed on the OLEDs of the pixels located in the ith rows in the pixel unit, a control signal input to the ith control line CLi may remain activated, and a scan signal input to an ith scan line Si may remain deactivated.

Figure 5:
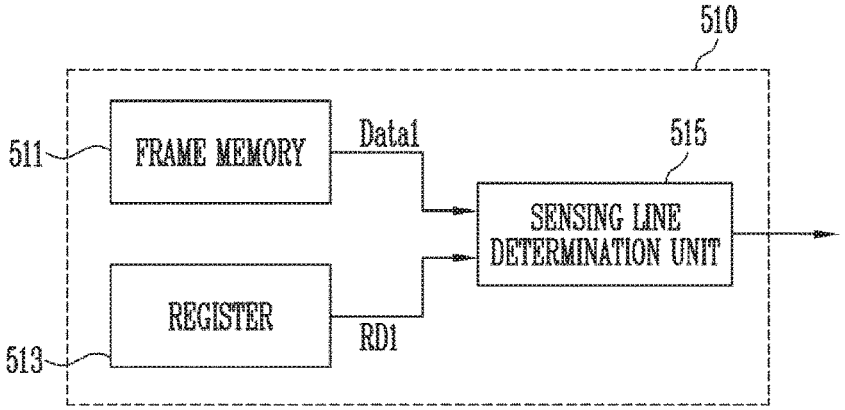
FIG. 5 is a block diagram illustrating a configuration of a timing controller shown in FIG. 4.

FIG. 5 is a block diagram illustrating a configuration of the timing controller shown in FIG. 4.

Referring to FIG. 5, a timing controller 510 may include a frame memory 511, a register 513, and a sensing line determination unit (e.g., determiner) 515. The frame memory 511 may store first data Data1 corresponding to a single frame. The sensing line determination unit 515 may calculate a representative value of pixels located in each row on the basis of the first data Data1 stored in the frame memory 511. According to an embodiment, the representative value may be a mean value of grayscale data corresponding to the pixels located in each row. The sensing line determination unit 515 may calculate a mean grayscale value with respect to pixels in a frame for each row on the basis of the first data Data1. When the grayscale data corresponding to each of the pixels is 8 bits, and when there are grayscale values corresponding to 256 levels, the mean grayscale value may have a value between 0 and 255.

The register 513 may store a first reference value RD1 to be compared against the representative value. The first reference value RD1 may be an arbitrary value (e.g., a predetermined arbitrary value). According to an embodiment, the first reference value RD1 may have a value of, for example, 200. When the grayscale data is 8-bit data, the first reference value RD1 may be a value selected from 0 to 255, and may be stored in the register 513. Hereinafter, operations of the display device according to an embodiment are described with reference to FIGS. 1 and 5.

The sensing line determination unit 515 may compare the calculated representative value with the first reference value RD1, and may determine whether or not to perform current sensing of pixels located in a corresponding row. For example, when the first reference value RD1 is 200, and when the calculated mean grayscale value of the data of the ith row is greater than 200, the sensing line determination unit 515 may determine whether to perform the current sensing of the pixels located in the ith row. The switching unit 170, the control line driver 160, and the scan driver 110 may operate to perform the current sensing of the OLEDs of the pixels located in the ith row under the control of the timing controller 510. For example, the control line driver 160 may activate a control signal input to the gate electrode of the fourth transistor M4 in each of the pixels of the ith row through the ith control line CLi. In addition, the scan driver 110 may deactivate a scan signal input to the gate electrode of the first transistor M1 in each of the pixels of the ith row through the ith scan line Si. The switching unit 170 may connect the first to mth data lines D1 to Dm to the sensing unit 180. During that period, the first to mth data lines D1 to Dm may not be coupled to the data driver 120. Therefore, while the current sensing is performed on the OLEDs of the pixels located in the ith row, data signals generated by the data driver 120 may not be transferred to the first to mth data lines D1 to Dm via the pixels in the ith row.

On the other hand, when the first reference value RD1 is 200 and a mean grayscale value of the ith row calculated by the sensing line determination unit 515 is greater than or equal to 200, the sensing line determination unit 515 may determine not to perform the current sensing of the pixels located in the ith row. The switching unit, the control line driver, and the scan driver may operate under the control of the timing controller so that the OLEDs of the pixels located in the ith row may emit light in response to the second data Data2. For example, the control line driver 160 may deactivate the control signal input to the gate electrode of the fourth transistor M4 in each of the pixels through the ith control line CLi to turn off the fourth transistor M4. In addition, the scan driver 110 may activate the scan signal input to the gate electrode of the first transistor M1 in each of the pixels through the ith scan line Si. The switching unit 170 may connect the first to mth data lines D1 to Dm to the data driver 120. During that period, the first to mth data lines D1 to Dm may not be connected to the sensing unit 180. Therefore, during that period, the OLEDs of the pixels located in the ith rows may emit light on the basis of the second data Data2 transferred through the first to mth data lines D1 to Dm. During that period, the sensing current generated by the sensing unit 180 may not be transferred to the OLEDs in the pixels located in the ith rows.

When the mean grayscale value of the data of the pixels located in the ith row is greater than the first reference value RD1, light emitting devices included in corresponding pixels may have relatively high light emitting current values, on average, during a light emitting period. Therefore, even when the current sensing is performed on the pixels located in the ith row, instead of the OLEDs of the pixels emitting light to display an image based on image data, it is difficult for a user to recognize the current sensing operation. For example, it is difficult for the user to tell whether light generated by the OLEDs of the corresponding pixels is generated by operations of the pixel circuit on the basis of the image data, or is generated by supplying the sensing current to sense (determine) deterioration information of the OLEDs. Therefore, undesirable visibility (e.g., visibility of an undesired display) may be avoided during a current sensing period of the OLEDs, such that image quality of the display device may be improved.

According to the above-described above embodiment, the sensing line determination unit 515 obtains the mean grayscale value of the data in the ith row based on the image data. However, in other embodiments, various statistical values may be calculated and generated as representative values. For example, in another embodiment, the sensing line determination unit 515 may calculate a median value of grayscale data applied to the pixels located in the ith row, and may compare the calculated median value with the first reference value RD1. According to another embodiment, the sensing line determination unit 515 may calculate a mode value of the grayscale data applied to the pixels located in the ith row, and may compare the mode value with the first reference value RD1. According to another embodiment, the sensing line determination unit 515 may determine a minimum (min) value of the grayscale data applied to the pixels, and may compare the minimum value with the first reference value RD1. For example, one of various statistical values determined by the sensing line determination unit 515 may be selected as a representative value to reduce undesirable visibility issues that might otherwise occur during the current sensing period, and may be compared with the first reference value RD1.

In the same or substantially similar manner as described above, the sensing line determination unit 515 may determine whether or not to perform the current sensing of the pixels 140 located in a corresponding row in a sequential manner from the first to nth rows. Therefore, the current sensing may be performed on the OLEDs of the pixels located in a row determined to have the current sensing performed thereon, and the OLEDs of the other pixels may emit light on the basis of (according to) the second data Data2. The display device according to an embodiment may calculate a representative value of data applied to pixels located in each row, and the calculated representative value may be compared with the first reference value RD1 to determine whether to perform the current sensing. Therefore, the OLEDs in a row having a relatively low grayscale value may emit light on the basis of image data instead of having the current sensing performed thereon. Therefore, even when an SNR (signal-to-noise ratio) of the sensing current is increased, undesirable visibility issues for the pixels on which the current sensing is performed may be reduced.

A current sensing operation of a display device for a single frame period according to an embodiment is further described below. The sensing line determination unit 515 may calculate a representative value (e.g., mean grayscale value) of the pixels located in the first row. The sensing line determination unit 515 may compare the calculated representative value with the first reference value RD1.

When the representative value is greater than the first reference value RD1, the sensing line determination unit 515 may determine to perform the current sensing operation of the pixels located in the first row, and may output a first sensing line selection signal. The output first sensing line selection signal may be transferred to the switching unit 170, to the control line driver 160, and to the scan driver 110. In response to the first sensing line selection signal, the switching unit 170 may connect the sensing unit 180 to the first to mth data lines D1 to Dm. The control line driver 160 may activate (generate) a control signal transferred through the first control line CL1. The scan driver 110 may deactivate (cease generation of) a scan signal transferred through the first scan lines S1. Therefore, the sensing current may be applied to the OLEDs of the pixels located in the first row such that a voltage corresponding to a deterioration degree of each of the OLEDs may be sensed (determined).

When the representative value is equal to or less than the first reference value RD1, the sensing line determination unit 515 may determine not to perform a current sensing operation on the pixels located in the first row, and may output a second sensing line selection signal. The output second sensing line selection signal may be transferred to the switching unit 170, to the control line driver 160, and to the scan driver 110. In response to the second sensing line selection signal, the switching unit 170 may connect the data driver 120 to the first to mth data lines D1 to Dm. The control line driver 160 may deactivate/cease generating the control signal transferred through the first control line CL1. The scan driver 110 may activate/generate the scan signal transferred through the first scan lines S1. Therefore, data output from the data driver 120 may be transferred to the pixel circuit of each of the pixels located in the first row so that OLEDs thereof may emit light having brightness corresponding to data being applied.

Subsequently, the same or substantially the same operations may be performed for pixels located in the second row. The same or substantially the same processes may be repeated (e.g., sequentially) for each of the rows of pixels until the nth row.

According to the above-described processes, the current sensing may be performed on the pixels located in a row where a representative value is greater than the first reference value RD1 from among the pixels located in n rows. Therefore, even when a high sensing voltage is applied to increase an SNR, unexpected visibility (e.g., display of an unexpected or undesired image) may be reduced. As a result, deterioration degrees of the OLEDs included in the pixels may be accurately compensated, and unexpected visibility issues may be avoided to thereby improve image quality of the display device.

Figure 6:
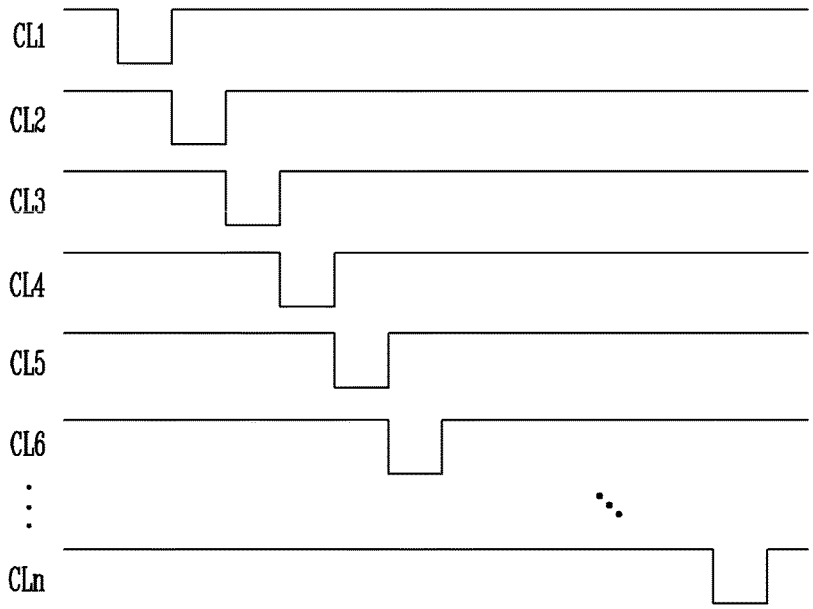
FIG. 6 is a timing diagram illustrating current sensing performed sequentially on each of the pixels in a pixel unit of a display device.

FIG. 6 is a timing diagram illustrating current sensing performed sequentially on each of the pixels in a pixel unit of a display device.

Referring to FIGS. 1 and 6, when the current sensing is sequentially performed on all of the pixels 140 in the pixel unit 130 of the display device, the control line driver 160 may sequentially activate control signals applied to the control lines CL1 to CLn. Therefore, the current sensing may be carried out on the OLEDs of the pixels located in the first row, the current sensing may be carried out on the OLEDs of the pixels located in the second row, and in the same or substantially the same manner, the current sensing may be performed on the OLEDs of the pixels located in the nth row. As described above, while control signals applied to the first to nth control lines CL1 to CLn are sequentially activated, the scan signals applied to the first to nth scan lines S1 to Sn may remain deactivated. In addition, while the control signals applied to the first to nth control lines CL1 to CLn are sequentially activated, the switching unit 170 may connect the first to mth data lines D1 to Dm to the sensing unit 180.

Figure 7:
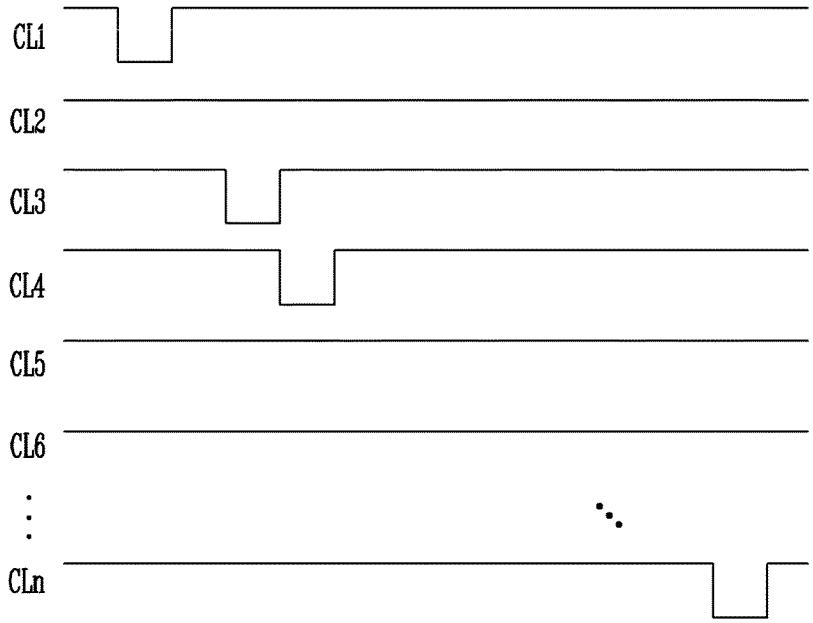
FIG. 7 is a timing diagram illustrating current sensing performed on some of the pixels in a pixel unit of a display device.

FIG. 7 is a timing diagram illustrating current sensing performed on some of the pixels in a pixel unit of a display device according to an embodiment.

Referring to FIGS. 1 and 7, the current sensing may be performed on some of the pixels 140 in the pixel unit 130 of the display device. For example, when a mean grayscale value of data applied to the pixels located in the first row is greater than the first reference value RD1, as illustrated in FIG. 7, the control line driver 160 may activate a control signal applied to the first control line CL1 on the basis of (according to) the first sensing line selection signal. The first to mth data lines D1 to Dm may be connected to the sensing unit 180, and the scan driver 110 may deactivate (may cease to generate) a scan signal applied to the first scan line S1.

When a mean grayscale value of the data applied to the pixels located in the second row is less than or equal to the first reference value RD1, the control line driver 160 may maintain the deactivated control signal applied to the second control line CL2 on the basis of the second sensing line selection signal. The first to mth data lines D1 to Dm may be connected to the data driver 120, and the scan driver 110 may activate a scan signal applied to the second scan line S2.

When a mean grayscale value of data applied to the pixels located in the third row is greater than the first reference value RD1, the control line driver 160 may activate a control signal applied to the third control line CL3 on the basis of the first sensing line selection signal. The first to mth data lines D1 to Dm may be connected to the sensing unit 180, and the scan driver 110 may deactivate a scan signal applied to the third scan line S3.

When a mean grayscale value of data applied to the pixels located in the fourth row is greater than the first reference value RD1, the control line driver 160 may deactivate the control signal applied to the fourth control line CL4 on the basis of the first sensing line selection signal. The first to mth data lines D1 to Dm may be connected to the sensing unit 180, and the scan driver 110 may deactivate a scan signal applied to the fourth scan line S4.

When a mean grayscale value of data applied to the pixels located in the fifth row is equal to or less than the first reference value RD1, the control line driver 160 may maintain the deactivated (may continue to not generate the) control signal applied to the fifth control line CL5 on the basis of the second sensing line selection signal. The first to mth data lines D1 to Dm may be connected to the data driver 120, and the scan driver 110 may activate a scan signal applied to the fifth scan line S5.

When a mean grayscale value of data applied to pixels located in the sixth row is less than or equal to the first reference value RD1, the control line driver 160 may maintain the deactivated control signal applied to the sixth control line CL6 on the basis of the second sensing line selection signal. The first to mth data lines D1 to Dm may be connected to the data driver 120, and the scan driver 110 may activate the scan signal applied to the sixth scan line S6.

In the same or substantially the same manner, whether or not to perform the current sensing may be determined for each row of pixels through the nth row. In response to the deactivation of the corresponding scan signal and the activation of the corresponding control signal, the current sensing may be performed on the OLEDs of the pixels in a row determined to be subject to the current sensing. The OLEDs may emit light on the basis of (according to) being included in pixels in a row determined not to be subject to the current sensing and, in this case, may emit light on the basis of (according to) data applied to the pixels in response to the activation of the corresponding scan signal and the deactivation of the control signal.

FIG. 8A is a view of an embodiment of a sensing current source included in the sensing circuit shown in FIG. 3, and FIG. 8B is a view of an embodiment of a sensing current source included in the sensing circuit shown in FIG. 3.

Referring to FIG. 8A, according to one embodiment, a sensing current source 810 included in the sensing circuit 340 shown in FIG. 3 may include a single current source 811. The sensing current source 810 may operate as a fixed current source. According to another embodiment, as illustrated in FIG. 8B, a sensing current source 830 included in the sensing circuit 340 shown in FIG. 3 may include a plurality of current sources 831*a*, 831*b*, . . . , 831*n* and a plurality of switching elements 832*a*, 832*b*, . . . , 832*n*. As shown in FIG. 8B, when the sensing current source 830 includes the plurality of current sources 831*a*, 831*b*, . . . , 831*n* and the plurality of switching elements 832*a*, 832*b*, . . . , 832*n*, the sensing current for sensing deterioration information of the OLEDs in respective pixels may be changed. The sensing current source 830 may operate as a variable current source. For example, to increase an SNR of a sensing voltage, the amount of current output from the sensing current source 830 may be increased. In another example, the amount of current output from the sensing current source 830 may be reduced to lower visibility when the current sensing is performed on an OLED. However, the brightness of light emitted by the OLED may be reduced during the current sensing.

Figure 9:
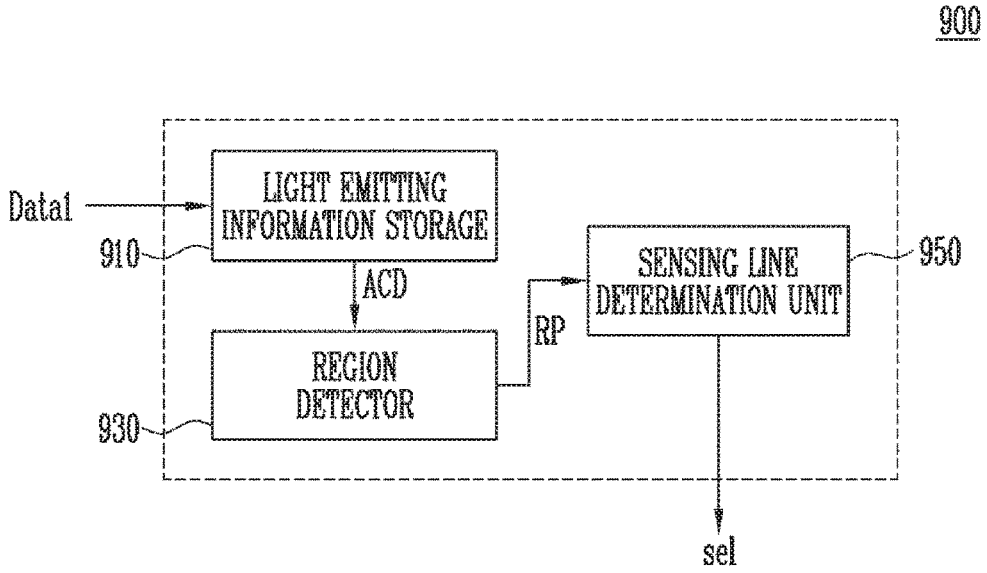
FIG. 9 is a block diagram illustrating a configuration of a timing controller shown in FIG. 4.

FIG. 9 is a block diagram illustrating a configuration of the timing controller shown in FIG. 4.

Referring to FIG. 9, a timing controller 900 may include a light emitting information storage 910 (e.g., a light emitting information memory), a region detector 930, and a sensing line determination unit 950. The light emitting information storage 910 may accumulate and store data Data1 input to the plurality of pixels. For example, the light emitting information storage 910 may store data input to each of the pixels for the past few frames. The light emitting information storage 910 may transfer the stored cumulative data ACD to the region detector 930.

The region detector 930 may detect a first light emitting region RP on the basis of the cumulative data ACD received from the light emitting information storage 910. The first light emitting region RP may be defined as a region that emits light having relatively high brightness for a certain amount of time (e.g., a predetermined amount of time). For example, a region of a TV screen where a logo of a broadcasting station is displayed may be defined as the first light emitting region RP. The first light emitting region RP may be described below in further detail with reference to FIG. 11. The detailed configuration and operation of the region detector 930 will be described in further detail with reference to FIG. 10.

The sensing line determination unit 950 may determine a sensing line to perform the current sensing on the basis of the first light emitting region RP detected by the region detector 930. For example, the sensing line determination unit 950 may determine to perform the current sensing of OLEDs of pixels located in all rows corresponding to (e.g., all rows in, or extending across) the first light emitting region RP.

Figure 10:
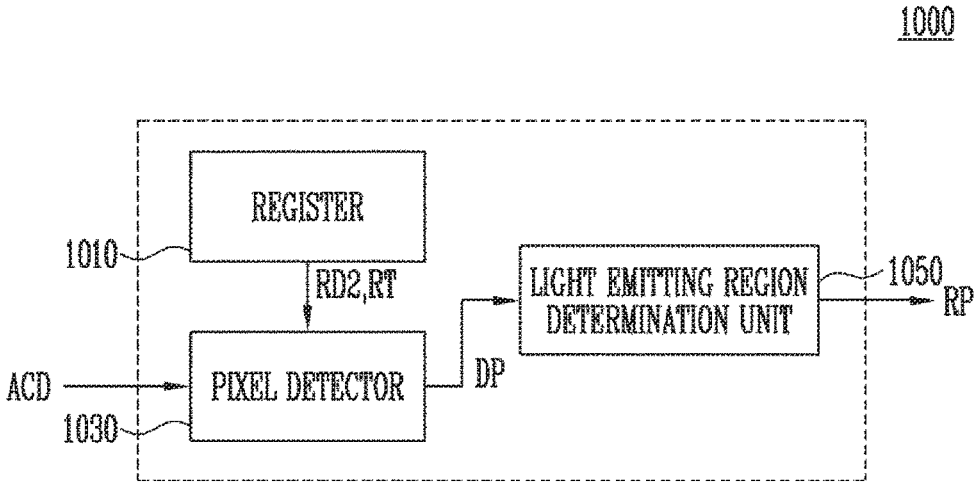
FIG. 10 is a block diagram illustrating an embodiment of a region detector shown in FIG. 9.

FIG. 10 is a block diagram illustrating an embodiment of a region detector shown in FIG. 9.

Referring to FIG. 10, a region detector 1000 may include a register 1010, a pixel detector 1030, and a light emitting region determination unit 1050. The register 1010 may store a second reference value RD2 and a first critical value RT. The second reference value RD2 and the first critical value RT may be reference values for determining whether or not a certain pixel (e.g., a predetermined pixel) emits light (e.g., continuously) having a certain brightness (e.g., a predetermined brightness) or greater for a certain amount of time (e.g., a predetermined amount of time).

The pixel detector 1030 may receive the cumulative data ACD from the light emitting information storage 910, and may receive the second reference value RD2 and the first critical value RT from the register 1010. The pixel detector 1030 may detect pixels which emit light (e.g., continuously emit light) with a certain brightness or greater for a certain amount of time on the basis of (according to) the cumulative data ACD, the second reference value RD2, and the first critical value RT. For example, referring to pixel data (e.g., predetermined pixel data) included in the cumulative data ACD, it may be determined whether or not the corresponding pixel data include as many successive grayscale data (e.g., as many frames including grayscale data) exceeding the second reference value RD2 as the first critical value RT. The second reference value RD2 may be a basis for determining whether or not the corresponding pixel emits light having a certain grayscale value or greater, and the first critical value RT may be a basis for determining whether or not the corresponding pixel emits light have greater than the corresponding grayscale value for a certain amount of time. For example, when the second reference value RD2 is 230, and when the first critical value RT is nmb, the pixel detector 1030 may detect a pixel which emits light (e.g., continuously emits light) having a grayscale value of 230 or higher for nmb/freq (sec) (where freq may refer to the number of times the pixel emits light per 1 second). The pixel detector 1030 may transfer information DP of the detected pixels to the light emitting region determination unit 1050.

The light emitting region determination unit 1050 may determine the first light emitting region RP on the basis of the information DP about the detected pixels transferred from the pixel detector 1030. According to an embodiment, the light emitting region determination unit 1050 may determine a region corresponding to all pixels represented in the information DP as the first light emitting region RP. According to another embodiment, the light emitting region determination unit 1050 may determine a region defined by k or more consecutive pixels arranged in a first direction (e.g., a predetermined first pattern) as the first light emitting region (where k is a natural number of 2 or more). The first direction may be a row direction or a column direction. According to another embodiment, the light emitting region determination unit 1050 may determine a region defined by k consecutive pixels arranged in the first direction and l consecutive pixels arranged in a second direction as the first light emitting region (where k is a natural number of 2 or more and l is a natural number of 2 or more). According to the above embodiment, pixels in an area smaller than a certain area (e.g., a predetermined area) of a panel of a display device may not form the first light emitting region. By defining the pixels forming a certain area or greater as the first light emitting region, undesirable visibility may be reduced when the current sensing is performed on pixels in the corresponding first light emitting region.

Figure 11:
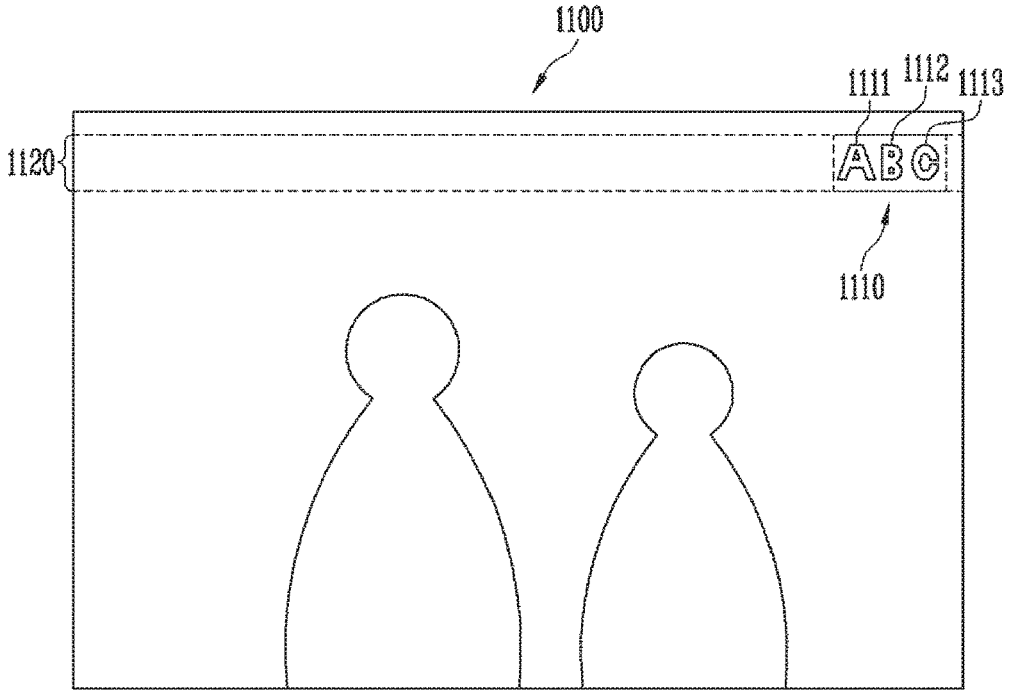
FIG. 11 is a screen illustrating an embodiment of a current sensing operation performed on some of the pixels by a timing controller shown in FIGS. 9 and 10.

FIG. 11 is a screen illustrating an embodiment of a current sensing operation performed on some of the pixels by a timing controller shown in FIGS. 9 and 10.

FIG. 11 illustrates a screen 1100 (e.g., a display screen) displayed by the display device. As described above, as for TV broadcasting, a logo or initials (e.g., "ABC") of a TV station may be displayed (e.g., continuously displayed) with relatively high brightness for a certain amount of time. Therefore, a region where the logo or the initials (e.g., "ABC) of the TV station (e.g., the first light emitting region 1110 described above with reference to FIGS. 9 and 10) may be detected, and the current sensing may be performed on rows 1120 including the pixels belonging to (in) the first light emitting region 1110.

For example, when the station's logo is "ABC," a region where A(1111), B(1112), and C(1113) are displayed displays (e.g., continuously displays) a grayscale value having relatively high brightness. Therefore, even when the current sensing is performed on the pixels belonging to the region where A(1111), B(1112), and C(1113) are displayed, it may be difficult for a user to recognize due to relatively low visibility. Therefore, when the current sensing is performed on sensing lines corresponding to the first light emitting region 1110 with greater frequency, deterioration information of light emitting device may be compensated more accurately, and undesirable visibility caused by the current sensing may be avoided or reduced.

Figure 12:
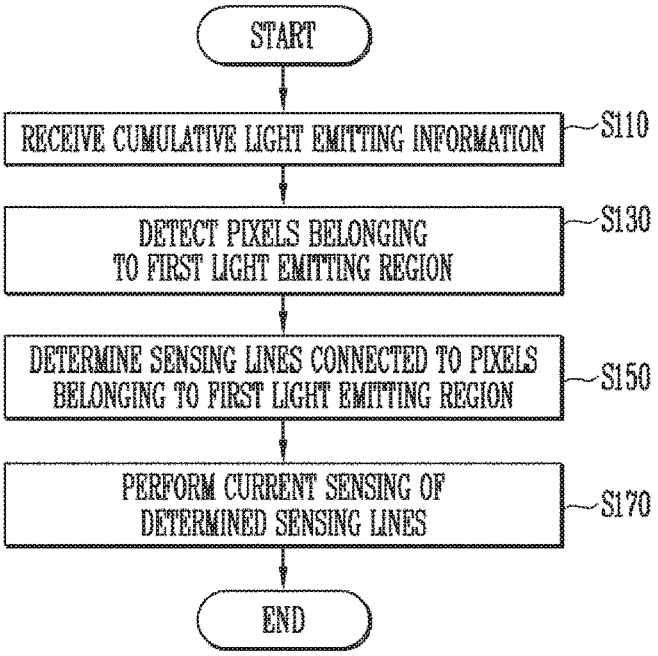
FIG. 12 is a flowchart of an embodiment of a method of performing sensing current of some of the pixels with reference to FIGS. 9-11.

FIG. 12 is a flowchart of an embodiment of a method of performing current sensing of some of a plurality of pixels by the method described above with reference to FIGS. 9-11.

Referring to FIG. 12, according to a method of performing current sensing of some of a plurality of pixels, cumulative light emitting information may be received at step S110, a first light emitting region including some of the plurality of pixels may be determined on the basis of (according to) the cumulative light emitting information S130, sensing lines coupled to the pixels in the first light emitting region may be determined at step S150, and current sensing may be performed on the determined sensing lines at step S170.

As described above with reference to FIGS. 9-11, at step S110, the cumulative data ACD stored in the light emitting information storage 910 may be received. At step S130, pixels that emit light (e.g., continuously emit light) having a certain brightness or greater for a certain amount of time may be detected on the basis of the cumulative data ACD, the second reference value RD2, and/or the first critical value RT. In addition, a region defined by the detected pixels may be determined (e.g., immediately determined) as a first light emitting region or a region defined by k consecutive pixels arranged in a first direction may be determined as the first light emitting region (where k is a natural number of 2 or more). Referring to FIGS. 11 and 12, at step S130 for determining the first light emitting region, a region where A(1111), B(1112), and C(1113) are displayed may be determined as the first light emitting region 1110.

Sensing lines coupled to the pixels in the determined first light emitting region 1110 may be determined at step S150. In FIG. 11, the determined sensing lines may correspond to the rows 1120. Current sensing may be performed on the pixels connected to the determined sensing lines at step S170.

Figure 13:
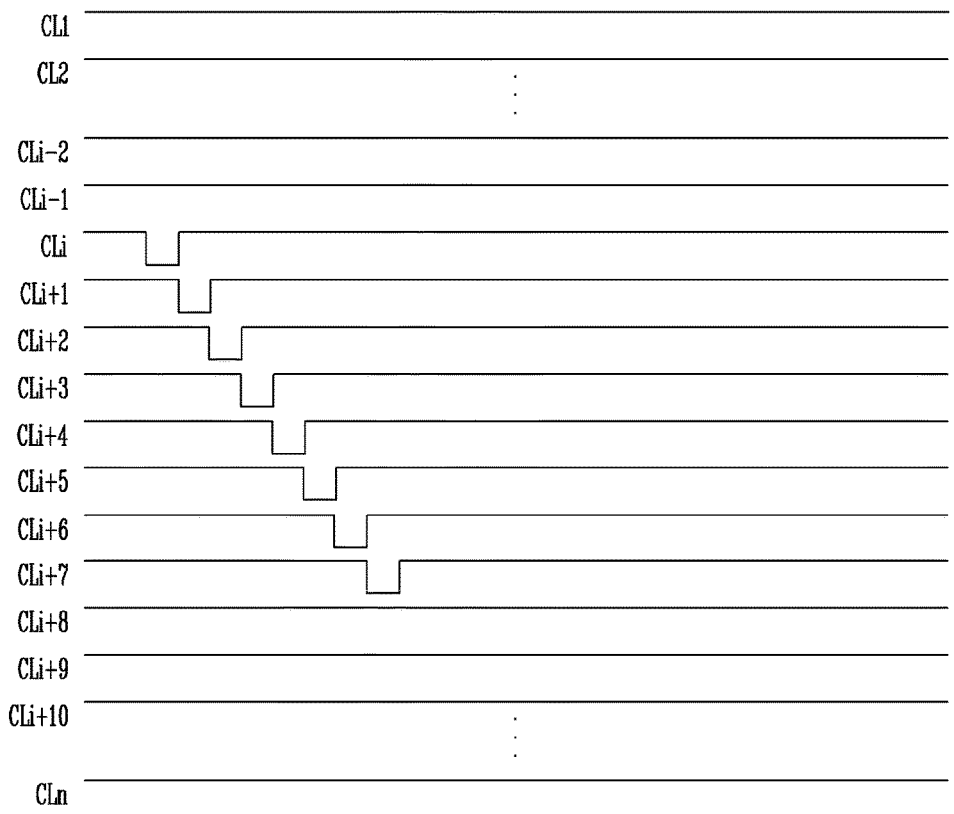
FIG. 13 is a timing diagram illustrating a current sensing operation performed to some pixels from among a plurality of pixels with reference to FIGS. 9-12.

FIG. 13 is a timing diagram illustrating a current sensing operation performed to some pixels from among of a plurality of pixels according to an embodiment described with reference to FIGS. 9-12.

Referring to FIGS. 11 and 13, the current sensing may be performed on the sensing lines corresponding to the rows 1120, and ith to (i+7)th rows shown in FIG. 13 may correspond to the rows 1120 shown in FIG. 11.

Therefore, to perform the current sensing of the OLEDs of the pixels located in the rows 1120 shown in FIG. 11, control signals applied to ith to (i+7)th control lines CLi to CLi+7 may be sequentially activated.

Before the control signals applied to the ith to (i+7)th control lines CLi to CLi+7 are sequentially activated, control signals applied to first to (i−1)th control lines CL1 to CLi−1 may remain deactivated. In addition, the switching unit may connect the first to mth data lines D1 to Dm to the data driver. Scan signals applied to first to (i−1)th scan lines S1 to Si−1 may be sequentially activated. Thus, the OLEDs of the pixels located in first to (i−1)th rows may emit light on the basis of (according to) data signals applied from the data driver.

While the control signals applied to the ith to (i+7)th control lines CLi to CLi+7 are sequentially activated, the scan signals applied to the ith to (i+7)th scan lines Si to Si+7 may remain deactivated. In addition, during the above period, the switching unit may connect the first to mth data lines D1 to Dm to the sensing unit. Therefore, the current sensing may be performed on the OLEDs of the pixels located in the ith to (i+7)th rows.

After the control signals applied to the ith to (i+7)th control lines CLi to CLi+7 are sequentially activated, control signals applied to (i+8)th to nth control lines CLi+8 to CLn may remain deactivated. In addition, during that period, the switching unit may connect the first to mth data lines D1 to Dm to the data driver. Scan signals applied to the (i+8)th to nth control lines CLi+8 to CLn may be sequentially activated. Therefore, the OLEDs of the pixels located in (i+8)th to nth rows may emit light on the basis of data signals applied from the data driver.

Figure 14:
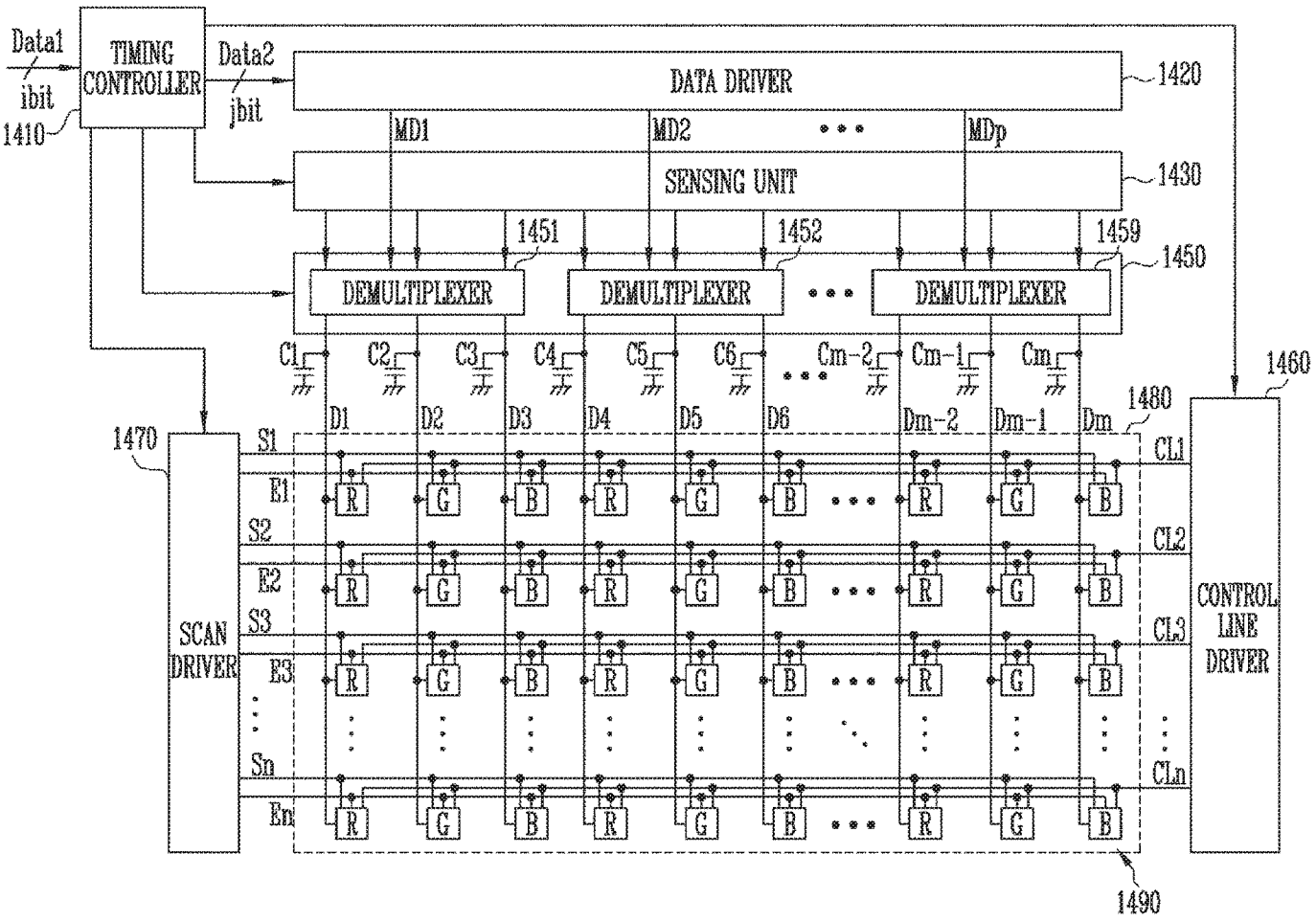
FIG. 14 is a block diagram illustrating a display device according to another embodiment.

FIG. 14 is a block diagram illustrating a display device according to another embodiment.

Referring to FIG. 14, the display device may include a pixel unit 1480 including pixels 1490 connected to scan lines S1 to Sn, light emission control lines E1 to En, and data lines D1 to Dm, a scan driver 1470 for driving the scan lines S1 to Sn and the light emission control lines E1 to En, a control line driver 1460 for driving control lines CL1 to CLn, a data driver 1420 for driving the data lines D1 to Dm, and a timing controller 1410 for controlling the scan driver 1470, the data driver 1420, and the control line driver 1460.

In addition, the display device according to an embodiment may include a sensing unit 1430 for extracting deterioration information of OLEDs included in the respective pixels 1490, and a switching unit 1450 for selectively connecting the sensing unit 1430 and the data driver 1420 to the data lines D1 to Dm. The display device may further include a control block for storing the information sensed (determined) by the sensing unit 1430.

The pixel unit 1480 may further include a plurality of pixels 1490 respectively located in regions divided by the scan lines S1 to Sn and the data lines D1 to Dm (e.g., located at respective regions where the scan lines S1 to Sn and the data lines D1 to Dm cross each other). Each of the pixels 1490 may emit light corresponding to a data signal from (e.g., received from) the data line D. The pixels 1490 may be divided into red pixels (R) for emitting red light, green pixels (G) for emitting green light, and blue pixels (B) for emitting blue light. Three pixels (e.g., sub-pixels) including (e.g., comprising or consisting of) the red pixel (R), the green pixel (G), and the blue pixel (B) may form a single unit pixel. However, the pixel unit 1480 having a red-green-blue (R-G-B) arrangement, as shown in FIG. 14, is shown as an example. In other embodiments, the pixel unit 1480 may have a red-green-blue-green (R-G-B-G) arrangement or a red-green-blue-white (R-G-B-W) arrangement.

Figure 18:
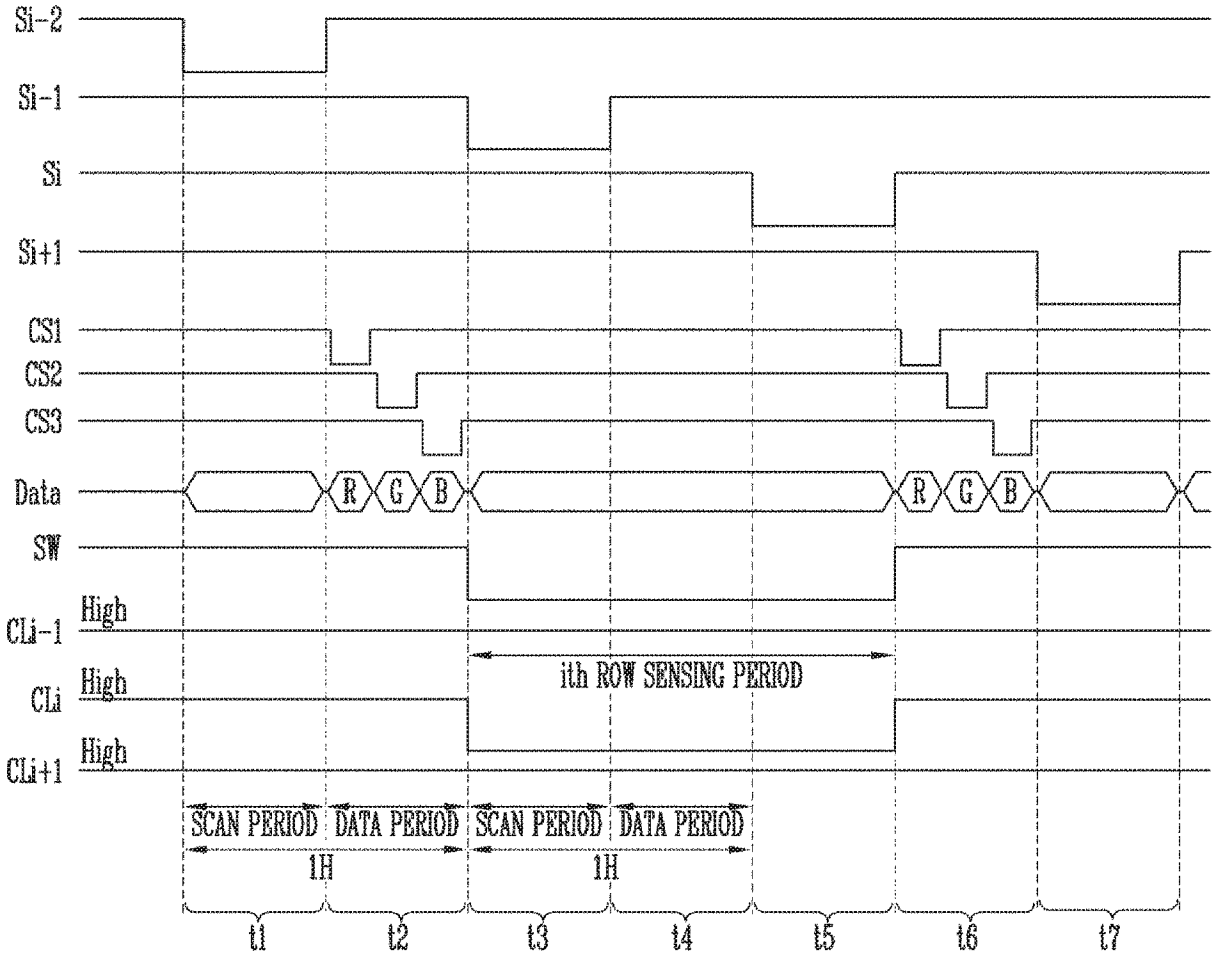
FIG. 18 is a timing diagram illustrating a current sensing operation performed to some of the pixels in a pixel unit of a display device according to an embodiment.

The scan driver 1470 may generate scan signals in response to control of the timing controller 1410 and may sequentially supply the generated scan signals to the scan lines S1 to Sn. As shown in FIG. 18, the scan driver 1470 may supply the scan signals for a portion of a single horizontal period 1H.

For example, according to an embodiment, the single horizontal period 1H may be divided into a scan period (e.g., a first period) and a data period (e.g., a second period). The scan driver 1470 may supply the scan signals to the scan lines S1 to Sn during the scan period of the single horizontal period 1H. In addition, the scan driver 1470 may not supply the scan signals during the data period of the single horizontal period. The scan driver 1470 may generate light emission control signals in response to control of the timing controller 1410, and may sequentially supply the generated light emission control signals to the light emission control lines E1 to En.

The data driver 1420 may generate multiplexed-data signals in response to control of the timing controller 1410, and may supply the generated multiplexed-data signals to multiplexed-data lines MD1 to MDp. As shown in FIG. 18, the data driver 1420 may sequentially supply three data signals to the multiplexed-data lines MD1 to MDp.

For example, the data driver 1420 may sequentially supply three data signals (e.g., R, G, B) to be supplied to the pixels during the data period of the single horizontal period 1H. Because the three data signals (e.g., R, G, B), which are to be supplied to the pixels, are supplied only during the data period, supply time of the data signals (e.g., R, G, B) to be supplied to the pixels, and supply time of the scan signals, may not overlap with each other.

The timing controller 1410 may generate data driving control signals and scan driving control signals in response to synchronization signals supplied from an external device. The data driving control signals generated by the timing controller 1410 may be supplied to the data driver 1420, and the scan driving control signals may be supplied to the scan driver 1470, to thereby control the data driver 1420 and the scan driver 1470.

The switching unit 1450 may include m/3 demultiplexers 1451, 1452, . . . , 1459. For example, the number of the demultiplexers 1451, 1452, . . . , 1459 included in the switching unit 1450 may be the same as the number of multiplexed-data lines MD1 to MDp. Each of the demultiplexers 1451, 1452, . . . , 1459 may be connected to one of the multiplexed-data lines MD1 to MDp. In addition, each of the demultiplexers 1451, 1452, . . . , 1459 may be connected to three data lines D. Each of the demultiplexers 1451, 1452, . . . , 1459 may demultiplex three signals supplied to the corresponding multiplexed-data lines MD1 to MDp, and may supply the demultiplexed three signals to the three corresponding data lines D during the data period.

As described above, when the data signal supplied to the single multiplexed-data line MD is supplied to the three data lines D, the number of output lines included in the data driver 1420 may be reduced. As shown in FIG. 14, the number of output lines included in the data driver 1420 may be reduced to a third of the original number, and the number of data integrated circuits included in the data driver 1420 may also be reduced. For example, according to one embodiment, because the data signal supplied to the single multiplexed-data line MD is supplied to the three data lines D by using the demultiplexers 1451, 1452, . . . , 1459, manufacturing costs may be reduced.

The timing controller 1410 may supply the three control signals to each of the demultiplexers 1451, 1452, . . . , 1459 during the data period of the single horizontal period so that the three data signals supplied to the multiplexed-data line MD may be divided and supplied to the three data lines D. The three control signals supplied by the timing controller 1410 may be sequentially supplied so as to not overlap with each other during the data period as shown in FIG. 18. One data capacitor Cdata (e.g., data capacitors C1 to Cm) may be provided at each of the data lines D. Each of the data capacitors Cdata may temporarily store a data signal supplied to the data line D, and may supply the stored data signal to the pixel 1490. The data capacitor Cdata may be used as a parasitic capacitor that is equivalent to capacitance of the data line D. For example, because the data capacitor Cdata (e.g., the parasitic capacitor) is equivalent to the data line D, and has a greater capacitance than a storage capacitor $C_{STG}$ included in each pixel 1500, as shown in FIG. 15, the data signal may be stably stored.

FIG. 15 is a circuit diagram illustrating one embodiment of a pixel shown in FIG. 14. For example, the pixel shown in FIG. 15 refers to a pixel 1500 located in a jth column and an ith row.

Referring to FIG. 15, the pixel 1500 may include (e.g., may be connected to) a data line Dj, an ith scan line Si, the (i−1)th scan line Si−1, an ith light emission control line Ei, first to eighth transistors T1 to T8, the storage capacitor $C_{STG}$, and an organic light emitting diode (OLED). The pixel 1500 may be connected to (e.g., may receive) the first power supply ELVDD, the second power supply ELVSS, and the initialization power supply VINT.

The eighth transistor T8 may be a sensing transistor, and may be turned on during a current sensing operation period of the OLED. For example, a gate electrode of the eighth transistor T8 may be coupled to the ith control line CLi. A pixel circuit including the first to seventh transistors T1 to T7 and the storage capacitor $C_{STG}$ may control current flowing through the OLED on the basis of (according to) data input from the jth data line Dj. For example, the pixel circuit including the first to seventh transistors T1 to T7 and the storage capacitor $C_{STG}$ may be located between the jth data line Dj, the ith scan line Si, and an anode electrode of the OLED. In addition, the pixel circuit including the first to seventh transistors T1 to T7 and the storage capacitor $C_{STG}$ may determine current flowing through the OLED on the basis of data transferred through the jth data line Dj. The OLED may emit light on the basis of the amount of the current. Therefore, the OLED may emit light having a brightness corresponding to the data transferred through the jth data line Dj.

When the OLED emits light on the basis of the data transferred through the jth data line Dj, the eighth transistor T8 may be turned off. Therefore, during the light emitting period, the OLED may emit light by (due to) operations of the pixel circuit including the first to seventh transistors T1 to T7 and the storage capacitor $C_{STG}$. When the current sensing is performed on the OLED, the eighth transistor T8 may be turned on, and the first to seventh transistors T1 to T7 may be turned off. When a deterioration degree of the OLED is to be sensed (determined), the eighth transistor T8 may be turned on in response to a control signal applied through the ith control line CLi, and a sensing current may be supplied through the jth data line Dj via the OLED.

When the sensing current is supplied to the OLED, a voltage (e.g., a predetermined voltage) corresponding to the deterioration degree of the OLED may be generated in the jth data line Dj. The voltage value may be sensed (determined or measured) by the sensing unit 1430 shown in FIG. 14, converted into deterioration information of the OLED of each of the sensed pixels, and transferred to the timing controller 1410. Therefore, the timing controller 1410 as shown in FIG. 14 may convert the first data Data1 into the second data Data2 on the basis of the transferred deterioration information of the OLED, and may transfer the second data Data2 to the data driver 1420. The pixel shown in FIG. 15 is merely an example, and pixels having various suitable configurations may be used as the pixel shown in FIG. 14.

When the sensing current is supplied to the OLED through the eighth transistor T8 to measure the deterioration degree of the OLED, the OLED may emit light according to the amount of the sensing current. For example, the OLED may emit light by (due to) the sensing current and not by (due to) the data applied to the jth data line Dj. However, a user may view light emission of the OLED due to the sensing current, which may adversely affect image quality of the display device. When a relatively high sensing current is applied to the OLED for more accurate sensing of the deterioration degree of the OLED, a sensing voltage may also be increased to improve a signal to noise ratio (SNR). However, the OLED may emit light having relatively high brightness, and the user may recognize light emission caused thereby. For example, when the sensing current is increased to improve the SNR of the sensing voltage for a period when the deterioration information of the OLED in the pixel is sensed, unexpected visibility may occur. However, because the display device according to an embodiment determines pixels to perform current sensing to on the basis of data applied to the pixels, undesirable visibility may be avoided to thereby improve image quality of the display device.

FIG. 15 illustrates the pixel 1500 including eight transistors T1 to T8 and one storage capacitor $C_{STG}$. However, the pixel of the display device is not limited thereto. For example, as illustrated in FIG. 2, the pixel 140 including the four transistors M1 to M4 and one storage capacitor Cst may be used, and a pixel circuit having various suitable configurations may be used in the display device according to embodiments of the present invention.

Figure 16:
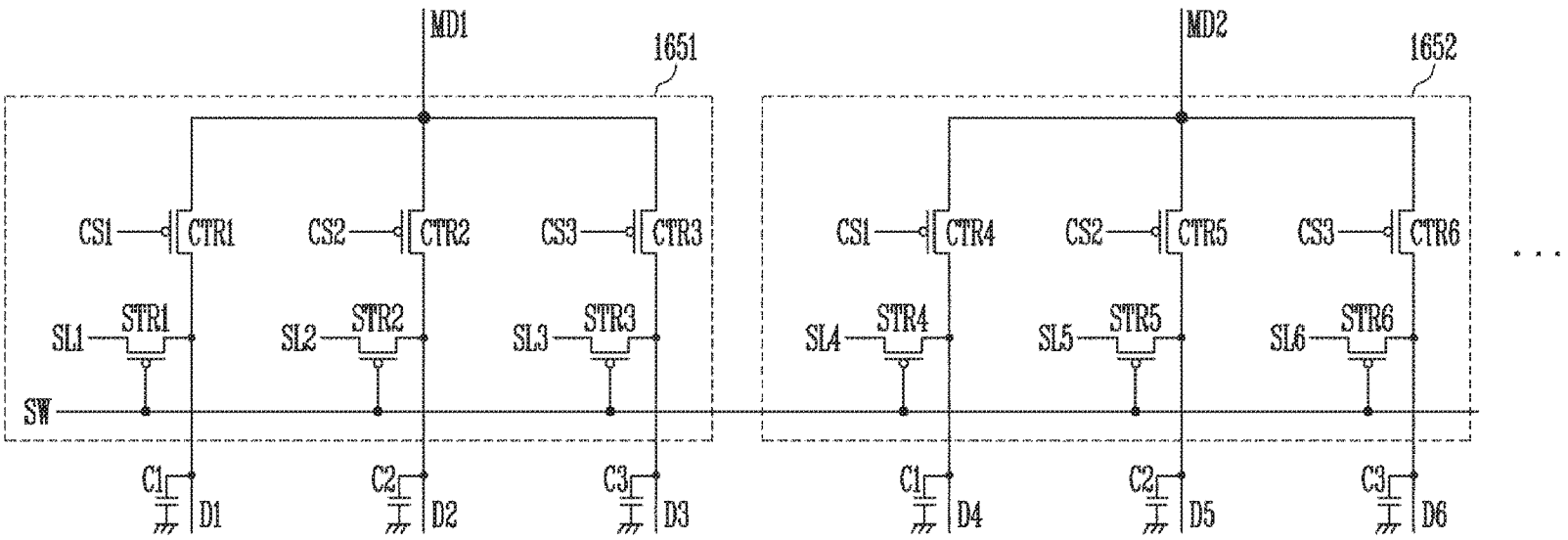
FIG. 16 is a partial internal circuit diagram of a switching unit shown in FIG. 14.

FIG. 16 is a partial internal circuit diagram of the switching unit shown in FIG. 14. FIG. 16 illustrates only first and second demultiplexers 1451 and 1452 from among the demultiplexers 1451, 1452, . . . , 1459 of the switching unit 1450 shown in FIG. 14. For example, first and second demultiplexers 1651 and 1652 shown in FIG. 16 may be the same or substantially the same as the first and second demultiplexers 1451 and 1452 shown in FIG. 16, respectively.

Referring to FIG. 16, the first demultiplexer 1651 may include first to third control transistors CTR1 to CTR3 and first to third switching transistors STR1 to STR3. Similarly, the second demultiplexer 1652 may include fourth to sixth control transistors CTR4 to CTR6 and fourth to sixth switching transistors STR4 to STR6.

The first control transistor CTR1 may be connected between the first multiplexed-data line MD1 and the first data line D1. The first control transistor CTR1 may be turned on when a first DEMUX-control signal CS1 is supplied from the timing controller 1410, and may supply a data signal supplied to the first multiplexed-data line MD1 to the first data line D1. The data signal supplied to the first data line D1 may be stored (e.g., temporarily stored) in the first data capacitor C1.

The second control transistor CTR2 may be coupled between the first multiplexed-data line MD1 and the second data line D2. The second control transistor CTR2 may be turned on when a second DEMUX-control signal CS2 is supplied from the timing controller 1410, and may supply the data signal supplied to the first multiplexed-data line MD1 to the second data line D2. The data signal supplied to the second data line D2 may be stored (e.g., temporarily stored) in the second data capacitor C2.

The third control transistor CTR3 may be coupled between the first multiplexed-data line MD1 and the third data line D3. The third control transistor CTR3 may be turned on when a third DEMUX-control signal CS3 is supplied from the timing controller 1410, and may supply the data signal supplied to the first multiplexed-data line MD1 to the third data line D3. The data signal supplied to the third data line D3 may be stored (e.g., temporarily stored) in the third data capacitor C3.

As described above, the first to third control transistors CTR1 to CTR3 may be sequentially turned on during a data period, and may transfer the data transmitted from the first multiplexed-data line MD1 to the first to third data lines D1 to D3, respectively. First to mth switching transistors STR1 to STRm (e.g., first to sixth switching transistors STR1 to STR6) may remain turned off (e.g., may remain turned off during the data period).

The first switching transistor STR1 may be connected between the first data line D1 and the first sensing line SL1. The first switching transistor STR1 may be turned on when a switching signal is supplied from a switching line SW, and may electrically connect the first sensing line SL1 and the first data line D1 to each other.

The second switching transistor STR2 may be connected between the second data line D2 and the second sensing line SL2. The second switching transistor STR2 may be turned on when the switching signal is supplied from the switching line SW, and may electrically connect the second sensing line SL2 and the second data line D2 to each other.

The third switching transistor STR3 may be coupled between the third data line D3 and the third sensing line SL3. The third switching transistor STR3 may be turned on when the switching signal is supplied from the switching line SW and may electrically connect the third sensing line SL3 and the third data line D3 to each other. The first demultiplexer 1651 may be operated as described above, and the second demultiplexer 1652 may be operated in substantially the same manner.

As illustrated in FIG. 16, the switching line SW may be connected in common to gate electrodes of the first to mth switching transistors STR1 to STRm (e.g., STR1 to STR6). When the current sensing is performed on OLEDs of pixels located in the ith row through the first to mth data lines D1 to Dm (e.g., first to sixth data lines D1 to D6), the switching signal may be supplied from the switching line SW such that the first to mth switching transistors STR1 to STRm may be turned on (e.g., may be turned on at the same time). The first to mth data lines D1 to Dm may be electrically connected to the first to mth sensing lines SL1 to SLm, respectively. The first to mth sensing lines SL1 to SLm may be coupled to the sensing unit 1430 shown in FIG. 14. Therefore, when the switching signal is supplied from the switching line SW, the sensing current may flow through the OLEDs of the pixels located in the ith row, and a sensing voltage in the first to mth data lines D1 to Dm may be transferred to the sensing unit.

Therefore, when the switching signal is supplied from the switching line SW, the first to third DEMUX-control signals CS1 to CS3 may not be supplied such that the first to mth control transistors CTR1 to CTRm (e.g., first to sixth control transistor TCR1 to CTR6) may remain turned off. The first to mth data lines D1 to Dm may not be electrically connected to the first to pth multiplexed-data lines MD1 to MDp.

Figure 17:
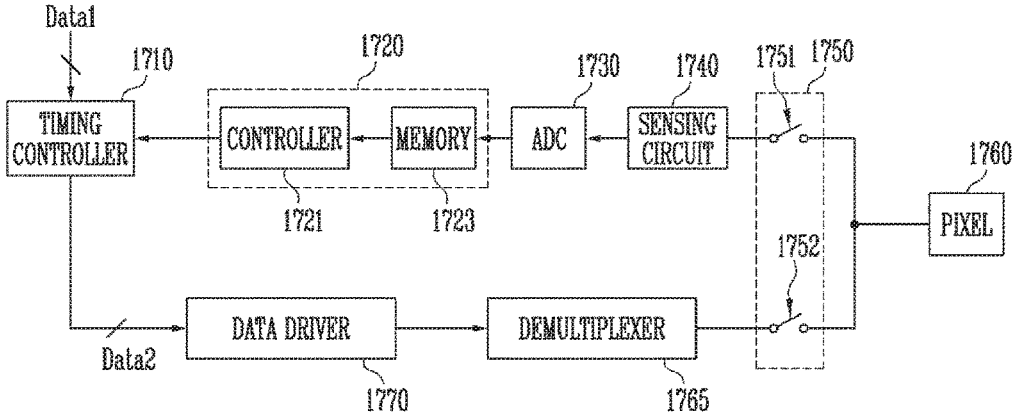
FIG. 17 is a schematic diagram of a switching unit, a sensing unit, and a control block shown in FIG. 14.

FIG. 17 is a schematic diagram of a switching unit, a sensing unit, and a control block as shown in FIG. 14. For convenience of explanation, in FIG. 17, the switching unit, the sensing unit, and the control block may be connected to the mth data line Dm.

Referring to FIG. 17, two switching elements 1751 and 1752 may be provided to each of the channels of the switching unit 1750. In addition, the sensing circuit 1740 and the ADC 1730 may be provided to each channel of the sensing unit (a single ADC may be employed for a plurality of channels, or all channels may share and use a single ADC). In addition, the control block 1720 may include a memory 1723 and a controller 1721.

The second switching element 1752 may be located between a data driver 1770 and the data line Dm. The second switching element 1752 may correspond to the mth control transistor CTRm described above with reference to FIG. 16. The second switching element 1752 may be turned on when the data signal is supplied from the data driver 1420. For example, the second switching element 1752 may remain turned on when the display device displays an image (e.g., a predetermined image). The first switching element 1751 may remain turned off when the second switching element 1752 is turned on.

As illustrated in FIGS. 8A and 8B, the sensing circuit 1740 may include at least one current source. The current source included in the sensing circuit 1740 may provide a current (e.g., a predetermined current) to a pixel 1760 when the first switching element 1751 is turned on, and may transfer a voltage (e.g., a predetermined voltage) generated in the data line Dm when the current is supplied thereto to the ADC 1730. The current may be provided through an organic light emitting diode (OLED) included in the pixel 1760. Therefore, voltage measured by the current generated from the current source in the sensing circuit 1740 may include deterioration information of the OLED in the pixel 1760. For example, when deterioration information is to be sensed (determined), the first switching element 1751 of the OLED of the pixel 1760 may be turned on and the second switching element 1752 thereof may remain turned off. The first switching element 1751 may correspond to the mth switching transistor STRm described above with reference to FIG. 16.

As the OLED deteriorates, a resistance value of the OLED may change. Therefore, a voltage value of the voltage may change as the OLED deteriorates such that the deterioration information of the OLED may be extracted (determined). The current value supplied from the current source in the sensing circuit 1740 may be experimentally determined.

The ADC 1730 may convert the voltage value supplied from the sensing circuit 1740 to a digital value.

The control block 1720 may include a memory 1723 and a controller 1721.

The memory 1723 may store the digital value supplied from the ADC 1730. The memory 1723 may store deterioration information of the OLEDs of all of the pixels 1490 included in the pixel unit 1480 shown in FIG. 14.

The controller 1721 may transfer the digital value stored in the memory 1723 to the timing controller 1710. That is, the controller 1721 may transmit the digital value extracted from the pixel 1760 to the timing controller 1710. The first data Data1 may be input to the timing controller 1710.

The timing controller 1710 may receive the first data Data1 from an external device, and may receive the digital value from the controller 1721. The timing controller 1710 receiving the digital value may change the bit value of the first data Data1 to generate the second data Data2 so that an image having uniform brightness may be displayed.

For example, as deterioration of the OLED progresses, the timing controller 1710 may generate the second data Data2 by increasing the bit value of the first data Data1 with reference to the digital value. As a result, the second data Data2 reflecting the deterioration information of the OLED may be generated such that generation of light having reduced brightness due to progression of the deterioration of the OLED may be reduced or prevented.

The data driver 1770 may generate the data signal by using the second data Data2, and may supply the generated data signal to a demultiplexer 1765. The demultiplexer 1765 may demultiplex the data signal, and may provide the demultiplexed data signal to the pixel 1760 coupled to the mth data line Dm. The data signal generated by the data driver 1770 may be transferred to the pixel 1760 through the second switching element 1752. For example, when the data signal is transferred from the data driver 1770 to the pixel 1760, the second switching element 1752 may be turned on and the first switching element may remain turned off.

FIG. 18 is a timing diagram illustrating a current sensing operation performed to some of the pixels included in a pixel unit of a display device according to an embodiment. For example, FIG. 18 illustrates operations of the timing controller 141 as shown in FIG. 14, which analyzes the first data Data1 and performs the current sensing on OLEDs of the pixels located in the ith row.

Referring to FIGS. 14-16 and 18, the current sensing may be performed on some of the pixels 1490 of the pixel unit 1480 of the display device. As one embodiment, FIG. 18 illustrates that the current sensing is performed on the pixels located in the ith row from among the pixels located in the first to nth rows.

First, a scan signal may be applied to an (i−2)th scan line Si−2 during a scan period t1 of a first single horizontal period 1H (t1 to t2). When the scan signal is supplied to the (i−2)th scan line Si−2, the fourth transistor T4 and the seventh transistor T7 included in each of the pixels located in an (i−1)th row may be turned on. The fourth transistor T4 of each of the pixels located in the (i−1)th row may be turned on when the scan signal is supplied to the (i−2)th scan line Si−2, and may supply a voltage of the initialization power supply VINT to a node to which a gate electrode of the first transistor T1 is connected. The seventh transistor T7 may be connected between the initialization power supply VINT and the anode electrode of the OLED. In addition, a gate electrode of the seventh transistor T7 may be coupled to the (i−2)th scan line Si−2. The seventh transistor T7 may be turned on when the scan signal is supplied to the (i−2)th scan line Si−2 and may supply the voltage of the initialization power supply VINT to the anode electrode of the OLED.

The second transistor T2 connected to the (i−1)th scan line Si−1 may remain turned off during the period t1 during which the scan signal is supplied to the (i−2)th scan line Si−2.

Subsequently, the first to third control transistors CTR1 to CTR3 of the pixels located in the (i−1)th row may be sequentially turned on by the first to third DEMUX-control signals CS1 to CS3, respectively, during a first data period t2. When the first control transistor CTR1 is turned on by the first DEMUX-control signal CS1, data provided to the multiplexed-data lines MD may be provided to the data line D coupled to the red pixels R from among the pixels located in the (i−1)th row. The data capacitors C1, C4, C7, . . . connected to the data lines D1, D4, D7, . . . connected to the red pixels R may be charged with a voltage corresponding to the supplied data signal.

When the second control transistor CTR2 is turned on by the second DEMUX-control signal CS2, the data supplied to the multiplexed-data lines MD may be supplied to the data line D connected to the green pixels G from among the pixels located in the (i−1)th row. The data capacitors C2, C5, C8, . . . connected to the data lines D2, D5, D8, . . . connected to the green pixels G may be charged with a voltage corresponding to the supplied data signal.

When the third control transistor CTR3 is turned on by the third DEMUX-control signal CS3, the data supplied to the multiplexed-data lines MD may be supplied to the data line D connected to the blue pixels B from among the pixels located in the (i−1)th row. The data capacitors C3, C6, C9, . . . connected to the data lines D3, D6, D9, . . . coupled to the blue pixels B may be charged with a voltage corresponding to the supplied data signal.

Because scan signals are not supplied during the data period t2, the data signal may not be supplied to the pixel circuits of the pixels located in the (i−1)th row.

Subsequently, the scan signal may be supplied to the (i−1)th scan line Si−1 during a second scan period t3 following the first data period t2. When the scan signal is supplied to the (i−1)th scan line Si−1, the second transistor T2 and the third transistor T3 of each of the pixels located in the (i−1)th row may be turned on. Therefore, the second transistor T2 included in each of the pixels located in the (i−1)th row may be turned on when the scan signal is supplied to the (i−1)th scan line Si−1 so that the data line Dj may be electrically connected to the first electrode of the first transistor T1.

For example, the data lines D1 to Dm may be charged with data voltages corresponding to the pixels located in the (i−1)th rows during the first data period t2, and the voltages charged to the data lines D1 to Dm may be stored in the storage capacitors in the pixels located in the (i−1)th rows during the second scan period t3. Subsequently, OLEDs included in the pixels located in the (i−1)th row may emit light having brightness corresponding to the data voltages in response to an (i−1)th light emission control signal Ei−1.

During the period t1 to t2, the switching signal may not be supplied to the switching line SW and the control signals may not be supplied to the first to nth control lines CL1 to CLn.

The switching signal may be supplied through the switching line SW during the period t3. FIG. 18 illustrates that switching signals and control signals are supplied during the period t3 to t5. The switching signal may be supplied during the period t3 to t5 so that the first to mth switching transistors STR1 to STRm may be turned on. Voltages in the first to mth data lines D1 to Dm may be transferred to the switching unit. In addition, the control signal may be supplied through the ith control line CLi during the period t3 to t5 so that in the eighth transistor T8 in each of the pixels located in the ith rows may be turned on. For example, the period t3 to t5 may be a sensing period during which the sensing current may flow through the OLEDs of the pixels located in the ith row, and a corresponding sensing voltage may occur in the first to mth data lines D1 to Dm. The sensing voltage may be transferred to the sensing unit through the first to mth switching transistors STR1 to STRm. Therefore, the deterioration information on the OLEDs of the pixels located in the ith rows may be transferred to the sensing unit during the period t3 to t5.

The first to third DEMUX-control signals CS1 to CS3 may not be supplied during the period t4.

FIG. 18 illustrates an embodiment of a current sensing operation performed on OLEDs of pixels located in an ith row during the period t3 to t5. However, this embodiment is only an example. The current sensing may be performed on the OLEDs of the pixels located in the ith row during a portion of the period t3 to t5 (e.g., during only a portion of the period t3 to t5). For example, while the current sensing period shown in FIG. 18 for the ith row may be the entire period t3 to t5, the current sensing period may be, but is not limited to, the period t3, the period t4, or the period t5. According to an embodiment, the current sensing period may be an arbitrary portion of the period of time including periods t3 to t5.

The scan signal may be supplied through the ith scan line Si during the period t5. When the scan signal is supplied to the ith scan line Si, the fourth transistor T4 and the seventh transistor T7 included in each of the pixels located in an (i+1)th row may be turned on. The fourth transistor T4 of each of the pixels located in the (i+1)th row may be turned on when the scan signal is supplied to the ith scan line Si, and may supply a voltage of the initialization power supply VINT to a node connected to the gate electrode of the first transistor T1. The seventh transistor T7 may be connected between the initialization power supply VINT and the anode electrode of the OLED. In addition, the gate electrode of the seventh transistor T7 may be coupled to the ith scan line Si. The seventh transistor T7 may be turned on when the scan signal is supplied to the ith scan line Si and may supply the voltage of the initialization power supply VINT to the anode electrode of the OLED. Subsequently, similar to the period t2, during the period t6 the first to mth data lines D1 to Dm may be charged with voltages corresponding to the data signals supplied through the multiplexed-data lines MD. During the period t7, a scan signal may be supplied through an (i+1)th scan line Si+1 and the storage capacitors $C_{STG}$ of the pixels located in the (i+1)th rows may be charged with the voltages charged to the first to mth data lines D1 to Dm. After the period t7, each of the OLEDs included in pixels located in the (i+1)th row may emit light having brightness corresponding to each of the data voltages in response to an (i+1)th light emission control signal Ei+1.

As described above, a display device according to an embodiment may perform current sensing on some of the pixels of a pixel unit. For example, as described above with reference to FIGS. 4, 5, and 9-12, the timing controller 1410 of the display device may determine a row in which pixels to be sensed are located. Subsequently, as described above with reference to FIG. 18, in response to control of the timing controller 1410, the current sensing may be performed on OLEDs of the pixels located in some of the rows in the pixel unit. In addition, the OLEDs of the pixels located in the remaining rows may emit light having brightness corresponding to the data voltages transferred through the data driver.

Figure 19:
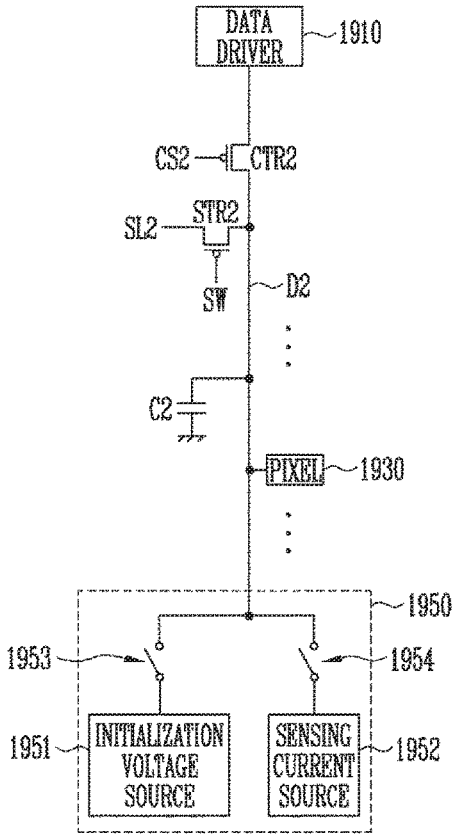
FIG. 19 is a block diagram illustrating a current sensing path for pixels of a display device according to an embodiment.

FIG. 19 is a block diagram illustrating a current sensing path for pixels of a display device according to an embodiment. FIG. 19 illustrates some of the components of the display device according to the embodiment. For example, FIG. 19 illustrates a current sensing path of a pixel coupled to the second data line D2.

A pixel 1930 may be coupled to the second data line D2 as shown in FIG. 19. The pixel 1930 may be located in a row determined to have the current sensing operation performed on by the timing controller. The second control transistor CTR2 and the second switching transistor STR2 included in the switching unit may be connected to the second data line D2. The second control transistor CTR2 may be coupled to a data driver 1910. As described above, the second control transistor CTR2 may be turned on by the second DEMUX-control signal input to the gate electrode and may transfer a data voltage supplied from the data driver 1910 to the second data line D2. The data voltage may be stored (e.g., temporarily stored) in the second data capacitor C2 coupled to the second data line D2. In addition, the second switching transistor STR2 may be turned on by the switching control signal supplied from the switching line SW, and may electrically connect the second data line D2 to the second sensing line SL2.

A data voltage of the previous row may be stored in the second data capacitor C2. For example, when the pixel 1930 shown in FIG. 19 is located in the ith row, the second data capacitor C2 may store a data voltage of a pixel located in an (i−1)th row and a second column before (e.g., right before) the current sensing. Therefore, during the current sensing of the OLED in the pixel 1930, a sensing voltage may be affected by the data voltage stored in the second data capacitor C2. Therefore, the display device according to the embodiment may initialize the voltage stored in the second data capacitor C2 of the second data line D2 during a sensing period and may subsequently perform the current sensing on the OLED of the pixel 1930.

Therefore, according to an embodiment, a sensing unit 1950 may include an initialization voltage source 1951, a sensing current source 1952, an initialization switching element 1953, and a sensing switching element 1954. At an initial stage of a sensing period, the initialization switching element 1953 may maintain a closed state to electrically connect the initialization voltage source 1951 and the second data line D2 to each other. In addition, during the sensing period, the sensing switching element 1954 may maintain an open state to electrically separate (electrically isolate) the sensing current source 1952 from the second data line D2. According to an embodiment, the initialization voltage source 1951 may be a constant voltage source. Therefore, the initialization voltage source 1951 connected to the second data line D2 may initialize the voltage of the second data capacitor C2 by the initialization switching element 1953.

After the voltage of the second data capacitor C2 is initialized, the initialization switching element 1953 may be changed to an open state, and the sensing switching element 1954 may be changed to a closed state. Therefore, the sensing current source 1952 may be connected to the second data line D2 by the sensing switching element 1954 so that the current sensing may be performed on the OLED included in the pixel 1930.

As illustrated in FIG. 19, the display device according to an embodiment may initialize the voltages stored in the data capacitors C1 to Cm of the first to mth data lines D1 to Dm at the initial stage of the sensing period and may perform current sensing of the OLEDs of the pixels connected to the first to mth data lines D1 to Dm, thereby improving sensing accuracy.

Figure 20:
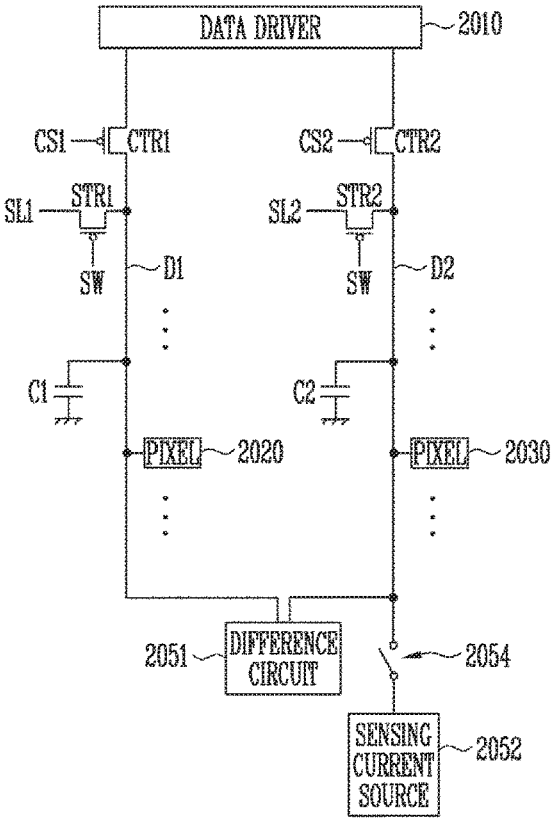
FIG. 20 is a block diagram illustrating a current sensing path for pixels of a display device according to an embodiment.

FIG. 20 is a block diagram illustrating a current sensing path for pixels of a display device according to an embodiment.

FIG. 20 illustrates the first and second data lines D1 and D2 and pixels 2020 and 2030 connected to the first and second data lines D1 and D2, respectively. In addition, as illustrated in FIG. 20, the first and second control transistors CTR1 and CTR2, the first and second switching transistors STR1 and STR2, and the first and second data capacitors C1 and C2 may be connected to the first and second data lines D1 and D2, respectively. A data driver 2010 may be connected to the first and second control transistors CTR1 and CTR2.

The second data line D2 may be selectively connected to a sensing current source 2052 by a sensing switching element 2054. In addition, a difference circuit 2051 (e.g., a differential circuit) may be coupled to the first data line D1 and the second data line D2.

When the sensing period starts, the sensing switching element 2054 may be changed into the closed state and the sensing current from the sensing current source 2052 may be transferred to the pixel 2030. The voltage corresponding to the pixel data in the previous row may be stored in the second data capacitor C2. For example, when the pixels 2020 and 2030 are located in the ith row, a voltage corresponding to data of a pixel located in the (i−1)th row and the second column (hereinafter, referred to as "(i−1, 2)") may be stored in the second data capacitor C2. When the sensing current flows through the OLED in the pixel 2030, a change in voltage corresponding to a deterioration degree of the OLED may occur in the second data line D2. The difference circuit 2051 may output a voltage difference between the voltage of the second data line D2 changed in response to the applied sensing current and the voltage of the first data line D1. The first data capacitor C1 connected to the first data line D1 may store a voltage corresponding to the data of the pixel located in the previous row. For example, when the pixels 2020 and 2030 are located in the ith row, the first data capacitor C1 may store the voltage corresponding to the data of the pixel located in the (i−1)th row and the first column (hereinafter, referred to as "(i−1, 1)").

In terms of probability, the data of the pixel located at (i−1, 2) and the data of the pixel located at (i−1, 1) may be likely to be similar to each other. Therefore, after the sensing current is applied to the second data line D2, the voltage difference between the voltage of the second data line D2 changed by the deterioration degree of the OLED and the voltage of the first data line D1 may be output to obtain an approximate value of the sensing voltage in response to the sensing current. A display device according to an embodiment may output a voltage difference between a voltage in a data line after applying a sensing current thereto and a voltage in a neighboring data line so as to generate a sensing voltage showing a deterioration degree of the OLED. The voltage difference output by the difference circuit 2051 may be transferred to the sensing circuit in the sensing unit.

Figure 21:
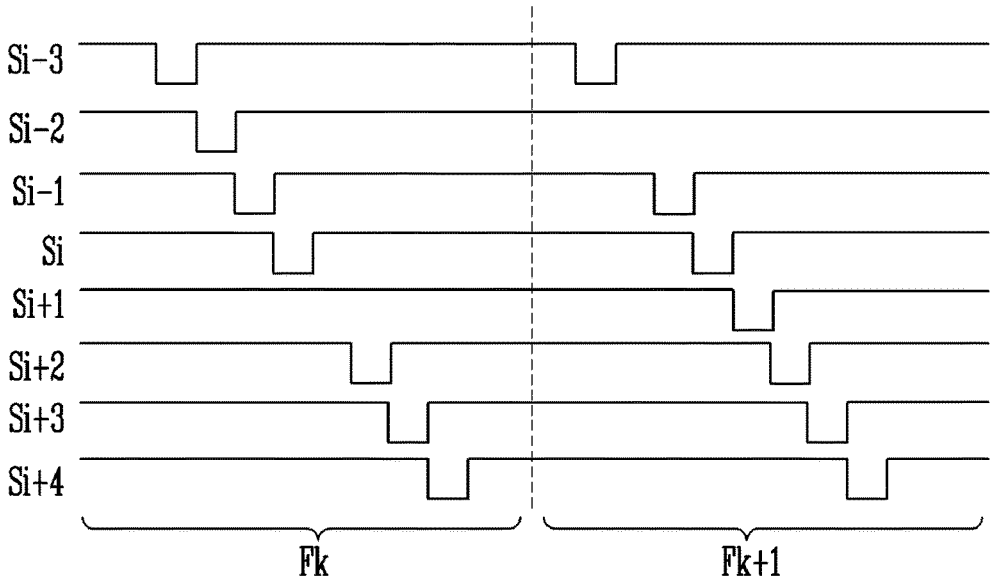
FIG. 21 is a timing diagram illustrating a sensing operation of a display device according to an embodiment.

FIG. 21 is a timing diagram illustrating a sensing operation of a display device according to an embodiment.

Referring to FIG. 21, the display device may cause some of the pixels to emit light in response to corresponding data voltages at each frame period (Fk, Fk+1), and may perform current sensing of other pixels.

Referring to a kth frame period Fk, while scan signals are sequentially supplied, a scan signal may not be supplied to an (i+1)th scan line Si+1. Instead, a control signal may be supplied to an (i+1)th control line CSi+1. Therefore, during the kth frame period Fk, the current sensing may be performed on pixels located in the (i+1)th row. In addition, during the kth frame period Fk, OLEDs of pixels located in the other rows except the (i+1)th row may emit light on the basis of data voltages being supplied thereto.

During a (k+1)th frame period Fk+1, the current sensing may be performed on pixels in an (i−2)th row. In addition, during the (k+1)th frame period Fk+1, OLEDs of pixels located in the other rows except the (i−2)th row may emit light on the basis of data voltages supplied thereto.

Figure 22:
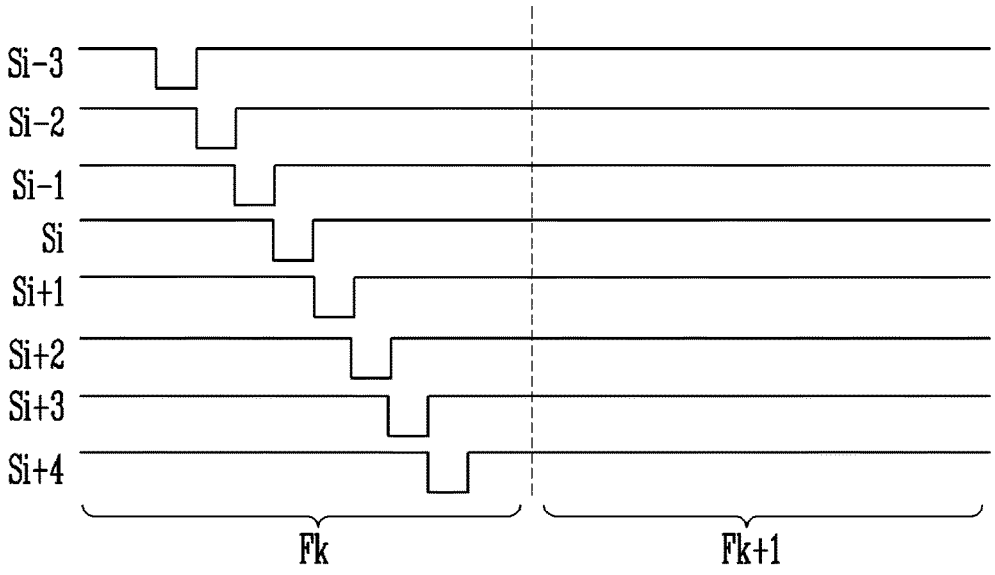
FIG. 22 is a timing diagram illustrating a sensing operation of a display device according to an embodiment.

FIG. 22 is a timing diagram illustrating a sensing operation of a display device according to an embodiment. Referring to FIG. 22, during the kth frame period Fk, the current sensing may not be performed on an OLED in a pixel. For example, during the kth frame period Fk when the current sensing is not performed, each of the OLEDs of all of the pixels may emit light having brightness corresponding to a data voltage.

During the (k+1)th frame period Fk+1, the current sensing may be performed on pixels located in a row selected by the timing controller. During the (k+1)th frame period Fk+1, scan signals may not be supplied through the first to nth scan lines Si to Sn. During the (k+1)th frame period Fk+1, the pixels to which the current sensing is not to be performed may emit light on the basis of data of the kth frame period Fk. According to another embodiment, during the (k+1)th frame period Fk+1, the pixels to which the current sensing is not to be performed may maintain a non-light emitting state. The pixels to which the current sensing is not to be performed may emit light or may not emit light depending on whether or not light emitting signals are applied to the light emission control lines corresponding to the rows except the row selected for the current sensing.

It will be understood that each block in the flowcharts and/or block diagrams, and combinations of blocks in the flowcharts and/or block diagrams, may be executed by computer program instructions. These computer program instructions may be provided to a processor of a general purpose computer, a special purpose computer, or other programmable data processing apparatus such that the computer program instructions, which may be executed via the processor of the computer or other programmable data processing apparatus, create the ability to implement one or more of the functions/acts specified in the flowchart(s) and/or block diagram block(s) or combinations thereof. These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart(s) and/or block diagram block(s) or combinations thereof. The computer program instructions may also be loaded onto a computer or other programmable data processing apparatus to cause a series of operational steps to be performed (not necessarily in a particular order) on the computer or other programmable apparatus to produce a computer implemented process such that the instructions which execute on the computer or other programmable apparatus provide steps for implementing the functions/acts (not necessarily in a particular order) specified in the flowchart(s) and/or block diagram block(s) or combinations thereof.

In addition, it will be understood that each block in the flowchart(s) and/or block diagrams, and combinations of blocks in the flowchart(s) and/or block diagrams, may represent a module, segment, or portion of code which comprises one or more executable computer program instructions for implementing the specified logical function(s)/act(s). It should be noted that, in some alternative implementations, the functions noted in the block(s) may occur out of the order noted in the figures. For example, two blocks shown in succession may, in fact, be executed substantially concurrently or the blocks may sometimes be executed in a reverse order depending upon the functionality involved.

The term "module" or "unit" as used herein denotes, but is not limited to, a software or hardware component, such as an FPGA or an ASIC which performs certain tasks. A module or a unit may be configured to reside on an addressable storage medium and may be configured to be executed on one or more network enabled devices or processors. Thus, a module or unit may include, by way of example, components, processes, functions, attributes, procedures, subroutines, segments of program code, driving modules, firmware, microcode, circuitry, data, databases, data structures, tables, arrays, variables, and the like. The functionality provided for in the components and modules may be combined into fewer components and modules or units or further separated into additional components and modules or units. Additionally, the components and modules may be implemented to be executed on one or more network enabled devices or computers.

Because a pixel of an organic light emitting display device deteriorates when used for a long period, an image having a desired brightness may not be displayed. To avoid or compensate for the deterioration of the pixels, a current sensing circuit configured to measure a deterioration level of a pixel may be provided, and a method of compensating for the deterioration of the pixel may be used.

When the current sensing is performed to measure (determine) a deterioration level of an OLED in a pixel, the current sensing may be carried out more accurately by increasing a signal-to-noise ratio (SNR) of a sensing current. However, because current flows in the OLED during the current sensing, when a voltage is increased to increase the SNR, the corresponding OLED may emit brighter light. Therefore, unexpected visibility issues may arise.

According to an embodiment, a display device is capable of reducing visibility of an OLED during a current sensing process.

Although example embodiments are disclosed herein, these embodiments should not be construed to be limiting. Those of ordinary skill in the art would recognize that various changes in form and details may be made without departing from the spirit and scope of the present invention as described in the appended claims and their equivalents.

What is claimed is:

1. A display device comprising:

a pixel unit comprising a plurality of pixels, each of the pixels comprising an organic light emitting diode (OLED);

a scan driver configured to supply scan signals to a plurality of scan lines connected to the plurality of pixels;

a data driver configured to supply data signals to a plurality of data lines connected to the plurality of pixels;

a control line driver configured to supply control signals to a plurality of control lines connected to the plurality of pixels;

a sensing unit configured to receive sensing voltages from the plurality of data lines during a sensing period;

a switching unit configured to selectively connect the plurality of data lines to the data driver and to the sensing unit, and configured to perform current sensing of the OLEDs of the pixels to which the control signals are supplied from among the plurality of pixels; and a timing controller configured to control operations of the scan driver, the data driver, the control line driver, the sensing unit, and the switching unit, configured to calculate a representative value of grayscale data corresponding to a first group of the pixels and control the control line driver according to the representative value, and configured to initiate the current sensing for the first group of the pixels when the representative value is greater than a first reference value.

2. The display device of claim 1, wherein the sensing unit is configured to generate deterioration information of the OLEDs of the pixels to which the control signals are supplied according to a result of the current sensing.

3. The display device of claim 2, wherein the sensing unit comprises:

a sensing circuit configured to sense voltages generated in the plurality of data lines as the result of the current sensing; and an analog-digital converter configured to convert the voltages sensed by sensing circuit into digital values of the deterioration information of the OLEDs.

4. The display device of claim 3, wherein the sensing circuit comprises:

a sensing current source configured to apply a sensing current to the plurality of data lines; and a voltage detector configured to detect the voltages generated in the plurality of data lines when the sensing current source applies the sensing current thereto.

5. The display device of claim 4, wherein the sensing current source comprises a fixed current source.

6. The display device of claim 4, wherein the sensing current source comprises a variable current source.

7. The display device of claim 2, further comprising a control block configured to store the deterioration information generated by the sensing unit.

8. The display device of claim 7, wherein the timing controller is configured to receive the deterioration information from the control block, and is configured to convert externally input first data into second data according to the deterioration information to compensate for deterioration of the OLEDs of the pixels.

9. The display device of claim 1, wherein the timing controller comprises:

a light emitting information storage configured to accumulate and store externally input first data;

a region detector configured to detect pixels in a first light emitting region from among the plurality of pixels according to the first data; and a sensing line determination unit configured to determine a sensing line on which to perform the current sensing according to the first light emitting region, and wherein the first light emitting region is a region where light is emitted at a certain brightness or greater for a certain amount of time.

10. The display device of claim 9, wherein the region detector comprises:

a register configured to store a second reference value and a first critical value;

a pixel detector configured to detect pixels sequentially receiving grayscale data greater than the second reference value a certain number of times exceeding the first critical value; and a light emitting region determination unit configured to determine the first light emitting region according to the pixels detected by the pixel detector.

11. The display device of claim 1, wherein each of the pixels further comprises:

a pixel circuit connected to one of the scan lines, to one of the data lines, to one of the control lines, and to an anode electrode of the organic light emitting diode, configured to control current supplied to the organic light emitting diode, and configured to transfer a sensing current to the organic light emitting diode during a current sensing operation period.

12. The display device of claim 11, wherein the pixel circuit comprises a sensing transistor connected between the anode electrode of the organic light emitting diode and the data line, and comprising a gate terminal connected to one of the control lines.

13. A display device comprising a pixel unit comprising a plurality of pixels, each of the pixels comprising an organic light emitting diode (OLED);

a scan driver configured to supply scan signals to a plurality of scan lines connected to the plurality of pixels;

a data driver configured to supply data signals to a plurality of data lines connected to the plurality of pixels;

a control line driver configured to supply control signals to a plurality of control lines connected to the plurality of pixels;

a sensing unit configured to receive sensing voltages from the plurality of data lines during a sensing period;

a switching unit configured to selectively connect the plurality of data lines to the data driver and to the sensing unit, and configured to perform current sensing of the OLEDs of the pixels to which the control signals are supplied from among the plurality of pixels; and a timing controller configured to control operations of the scan driver, the data driver, the control line driver, the sensing unit, and the switching unit, and configured to control the control line driver to supply the control signals to one or more of the control lines according to externally input first data, wherein the timing controller comprises:

a frame memory configured to temporarily store the first data;

a register configured to store a first reference value, the first reference value configured to determine on which of the pixels the current sensing is to be performed; and a sensing line determination unit configured to calculate a representative value of data corresponding to the pixels in each row according to the first data, and configured to compare the representative value with the first reference value.

14. The display device of claim 13, wherein, when the representative value is greater than the first reference value, the sensing line determination unit is configured to determine to perform the current sensing of the pixels in a corresponding row.

15. The display device of claim 14, wherein the control line driver is configured to supply a control signal to a control line connected to the pixels in the corresponding row in response to the determination to perform the current sensing.

16. The display device of claim 15, wherein the switching unit is configured to connect the plurality of data lines to the sensing unit during a single horizontal period corresponding to the corresponding row.

17. The display device of claim 13, wherein, when the representative value is less than or equal to the first reference value, the sensing line determination unit is configured to determine to omit performing the current sensing of the pixels in a corresponding row.

18. The display device of claim 17, wherein, in response to a determination to omit the performing the current sensing, the control line driver is configured to omit supplying a control signal to a control line connected to the pixels in the corresponding row.

19. The display device of claim 17, wherein, in response to a determination to omit the performing the current sensing, the scan driver is configured to supply a scan signal to a scan line connected to the pixels in the corresponding row.

20. The display device of claim 19, wherein the switching unit is configured to connect the plurality of data lines to the data driver during a single horizontal period corresponding to the corresponding row.

21. The display device of claim 20, wherein the pixels in the corresponding row are configured to receive the data signals from the data driver through the plurality of data lines, and wherein each of the OLEDs emits light having brightness corresponding to each of the data signals.

22. The display device of claim 13, wherein the representative value comprises a mean value of the data corresponding to the pixels in each row.

23. The display device of claim 13, wherein the representative value comprises a median value of the data corresponding to the pixels in each row.

24. The display device of claim 13, wherein the representative value comprises a mode value of the data corresponding to the pixels in each row.

25. A display device comprising:

a pixel unit connected to a plurality of scan lines, to a plurality of data lines, and to a plurality of control lines the plurality of control lines comprising n control lines, the pixel unit comprising a plurality of pixels arranged in an n×m matrix format;

a control line driver configured to supply a control signal to at least one of the control lines according to grayscale data corresponding to the plurality of pixels;

a sensing unit configured to perform current sensing of the pixels receiving the control signal; and a timing controller configured to control operations of the control line driver and the sensing unit and configured to determine at least one of the n rows to which the current sensing is to be performed according to the grayscale data, wherein the control line driver is configured to supply the control signal to a control line from among the n control lines corresponding to the at least one of the n rows determined by the timing controller.

26. The display device of claim 25, wherein the timing controller comprises:

a frame memory configured to store the grayscale data corresponding to the plurality of pixels;

a register configured to store a first reference value by which the pixels to which the current sensing is to be performed are determined; and a sensing line determination unit configured to calculate a representative value of grayscale data corresponding to the pixels in an ith row (where i is a natural number greater than or equal to 1 and less than or equal to n) according to the grayscale data stored in the frame memory, and configured to compare the representative value with the first reference value.

27. The display device of claim 26, wherein, when the representative value is greater than the first reference value, the sensing line determination unit is configured to determine to perform the current sensing of the pixels in the ith row.

28. The display device of claim 27, wherein the representative value is a mean value of the data corresponding to the pixels in the ith row.

29. The display device of claim 25, wherein the timing controller comprises:

a light emitting information storage configured to accumulate and store the grayscale data corresponding to the plurality of pixels;

a region detector configured to detect pixels in a first light emitting region from among the plurality of pixels according to the data accumulated and stored in the light emitting information storage; and a sensing line determination unit configured to determine a sensing line to which the current sensing is performed according to the first light emitting region, and wherein the first light emitting region is a region where light is emitted at a certain brightness or greater for a certain amount of time.

30. The display device of claim 29, wherein the region detector comprises:

a register configured to store a second reference value and a first critical value;

a pixel detector configured to detect pixels sequentially receiving grayscale data greater than the second reference value a certain number of times exceeding the first critical value; and a light emitting region determination unit configured to determine the first light emitting region according to the pixels detected by the pixel detector.

31. The display device of claim 25, further comprising:

a data driver configured to supply data signals to the plurality of data lines;

a scan driver configured to supply scan signals to the plurality of scan lines; and a switching unit configured to selectively connect the plurality of data lines to one of the data driver and the sensing unit.

32. The display device of claim 31, wherein the switching unit comprises a plurality of demultiplexers configured to demultiplex and supply the data signals output from the data driver to the plurality of data lines.

33. The display device of claim 25, wherein the sensing unit comprises:

an initialization voltage source configured to initialize a voltage generation in at least one of the plurality of data lines during a sensing period; and a sensing current source configured to transfer a sensing current to at least one of the plurality of data lines after the initialization voltage source initializes the voltage generated in the at least one of the plurality of data lines.

34. The display device of claim 33, wherein the sensing unit comprises at least one switching element configured to selectively connect one of the initialization voltage source and the sensing current source to at least one of the plurality of data lines.

35. The display device of claim 25, wherein the sensing unit comprises:

a sensing current source configured to supply a sensing current to a jth data line (where j is a natural number greater than or equal to 1 and is less than or equal to m) from among the plurality of data lines; and a difference circuit configured to output a voltage difference between a voltage in the jth data line and a voltage in a data line adjacent to the jth data line when the sensing current source supplies the sensing current to the jth data line.

36. The display device of claim 35, wherein the sensing unit further comprises a switching element configured to selectively connect the sensing current source to the jth data line.

* * * * *